US011351591B2

(12) United States Patent
Oooka et al.

(10) Patent No.: US 11,351,591 B2
(45) Date of Patent: Jun. 7, 2022

(54) HOLD DEVICE

(71) Applicant: NIPPON STEEL CORPORATION, Tokyo (JP)

(72) Inventors: Kazunori Oooka, Tokyo (JP); Toshimitsu Aso, Tokyo (JP); Hiroshi Yoshida, Tokyo (JP); Daisuke Yasufuku, Tokyo (JP); Yasuharu Tanaka, Tokyo (JP); Takashi Miyagi, Tokyo (JP); Junichiro Suzuki, Tokyo (JP); Shinobu Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/770,417

(22) PCT Filed: Dec. 6, 2018

(86) PCT No.: PCT/JP2018/045002

§ 371 (c)(1),
(2) Date: Jun. 5, 2020

(87) PCT Pub. No.: WO2019/112023

PCT Pub. Date: Jun. 13, 2019

(65) Prior Publication Data

US 2020/0290105 A1 Sep. 17, 2020

(30) Foreign Application Priority Data

Dec. 7, 2017 (WO) ..... PCT/JP2017/045002

(51) Int. Cl.
*B21D 24/04* (2006.01)
*B21D 5/01* (2006.01)
(Continued)

(52) U.S. Cl.
CPC ..... *B21D 24/04* (2013.01); *B21D 5/01* (2013.01); *B21D 22/06* (2013.01); *B21D 22/22* (2013.01); *B21D 24/12* (2013.01)

(58) Field of Classification Search
CPC ..... B21D 24/04; B21D 24/06; B21D 22/06; B21D 22/22; B21D 22/26; B21D 5/01; B21D 24/10; B21D 24/12; B21D 22/24
See application file for complete search history.

(56) References Cited

U.S. PATENT DOCUMENTS

2016/0221068 A1 8/2016 Tanaka et al.

FOREIGN PATENT DOCUMENTS

CN 107243562 * 10/2017 ..... B21D 22/22
CN 107243562 A 10/2017
(Continued)

OTHER PUBLICATIONS

Qi, Translation of CN 107243562 (Year: 2017).*
International Search Report for PCT/JP2018/045002 mailed on Mar. 12, 2019.

*Primary Examiner* — Gregory D Swiatocha
*Assistant Examiner* — Bobby Yeonjin Kim
(74) *Attorney, Agent, or Firm* — Birch, Stewart, Kolasch & Birch, LLP

(57) ABSTRACT

A hold device is attached to press tooling. The hold device includes a distance member attached to a holder, and a moving device attached to a first die unit. The holder is provided in a movable manner with respect to a punch in a press direction, and a pad is provided in a movable manner with respect to a die in the press direction. The distance member is pivotable between a home position in which the distance member does not come into contact with the second die and a preventive position in which the distance between the pad and the holder in the press direction is prevented from being equal to or less than a predetermined distance. As
(Continued)

the holder moves relative to the punch in the first direction, the moving device causes the distance member to pivot from the home position toward the preventive position.

8 Claims, 27 Drawing Sheets

(51) Int. Cl.

| | |
|---|---|
| ***B21D 22/06*** | (2006.01) |
| ***B21D 22/22*** | (2006.01) |
| ***B21D 24/12*** | (2006.01) |

(56) References Cited

FOREIGN PATENT DOCUMENTS

| | | | |
|---|---|---|---|
| JP | 61-17224 | U | 1/1986 |
| JP | 2017-170482 | A | 9/2017 |
| WO | WO 2015/046023 | A1 | 4/2015 |

* cited by examiner

[Fig.1]
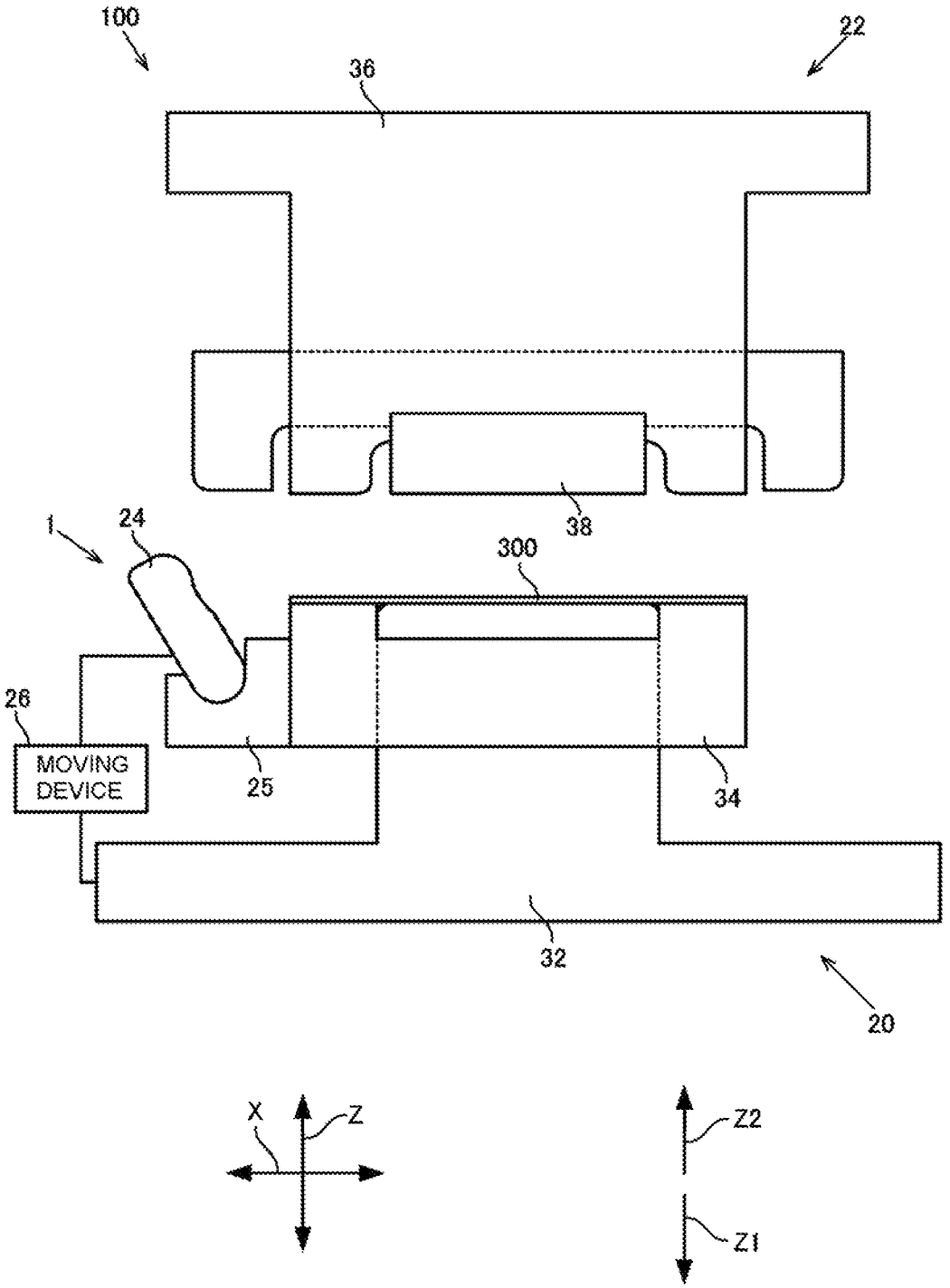

[Fig.2]
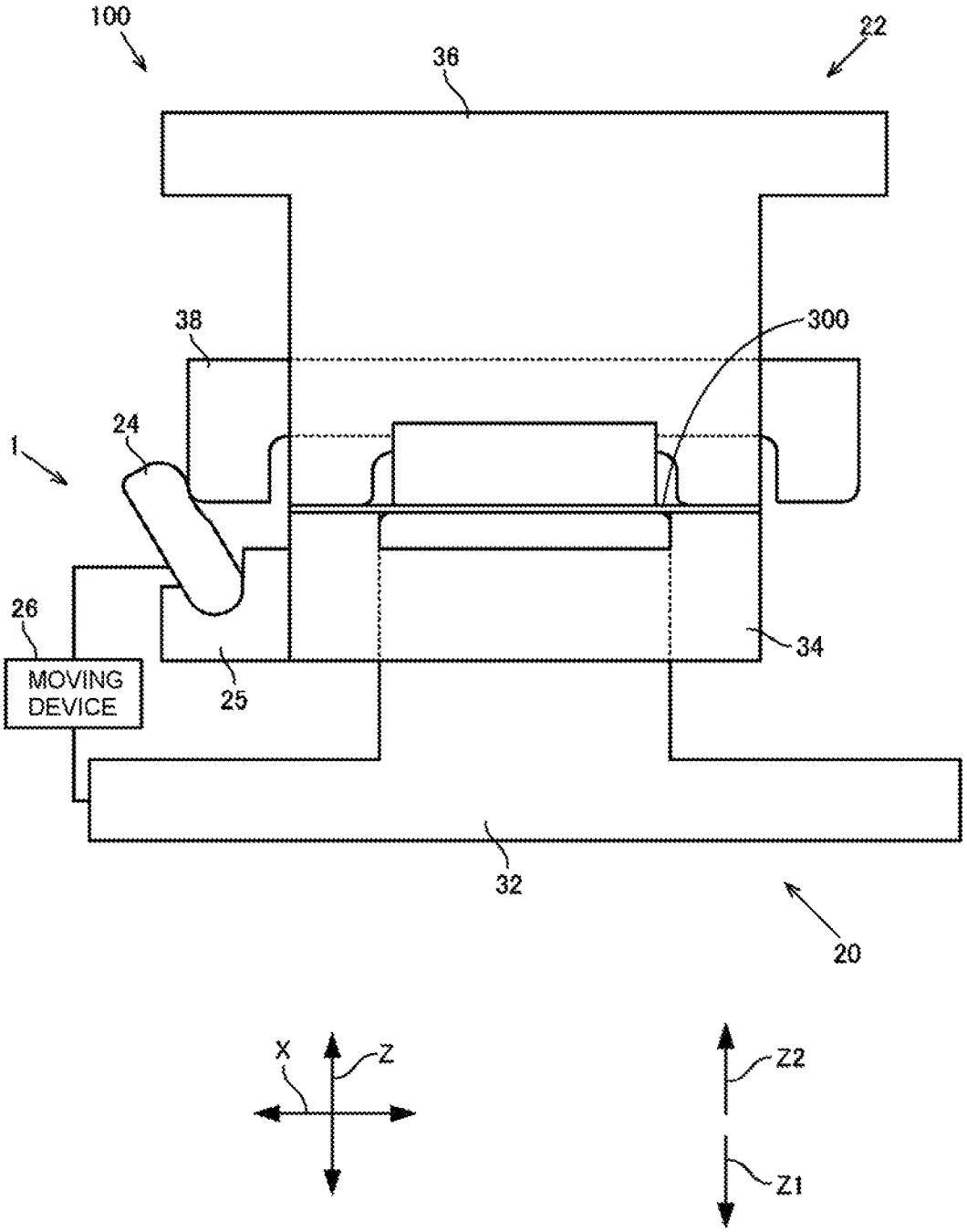

[Fig.3]
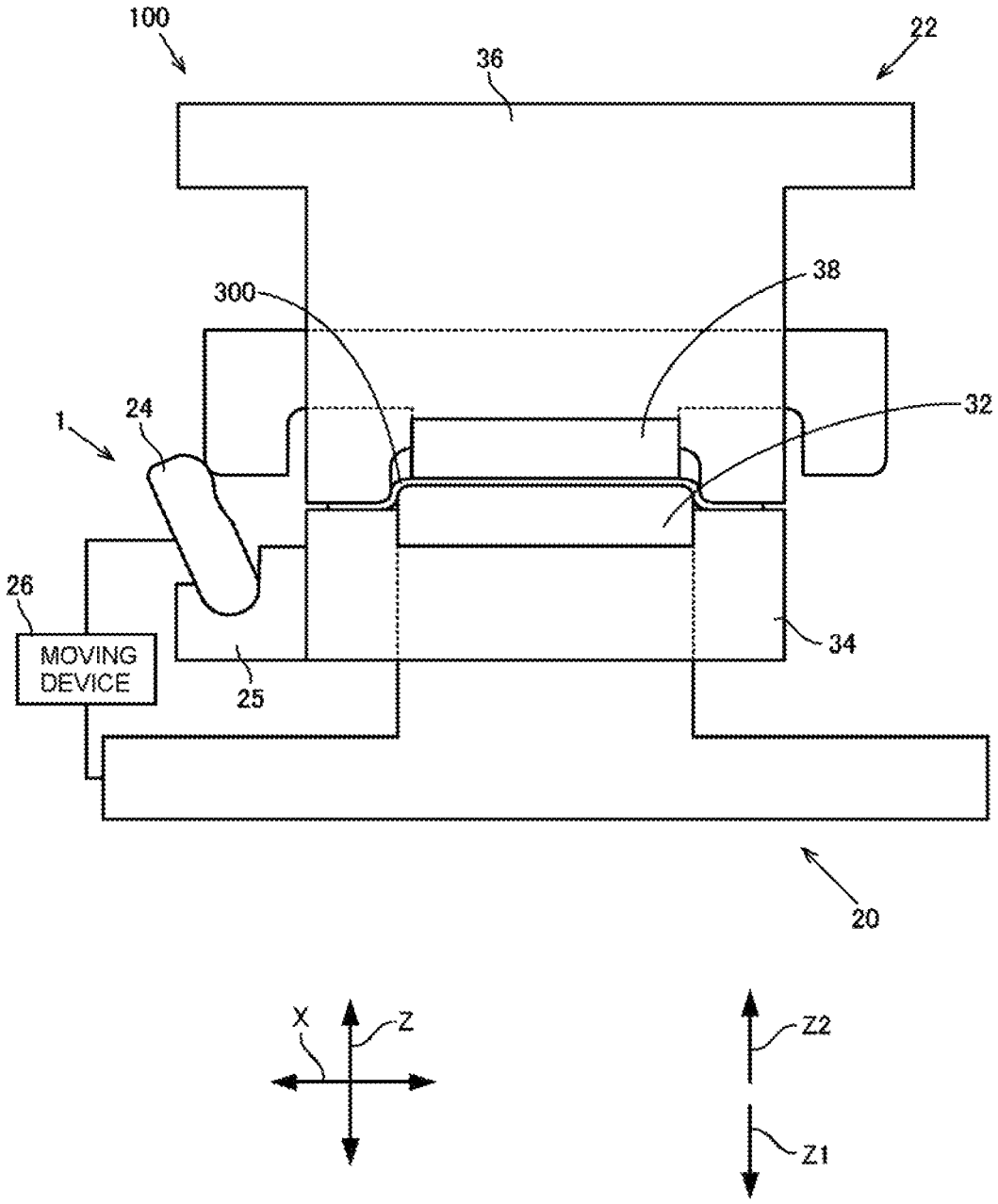

[Fig.4]
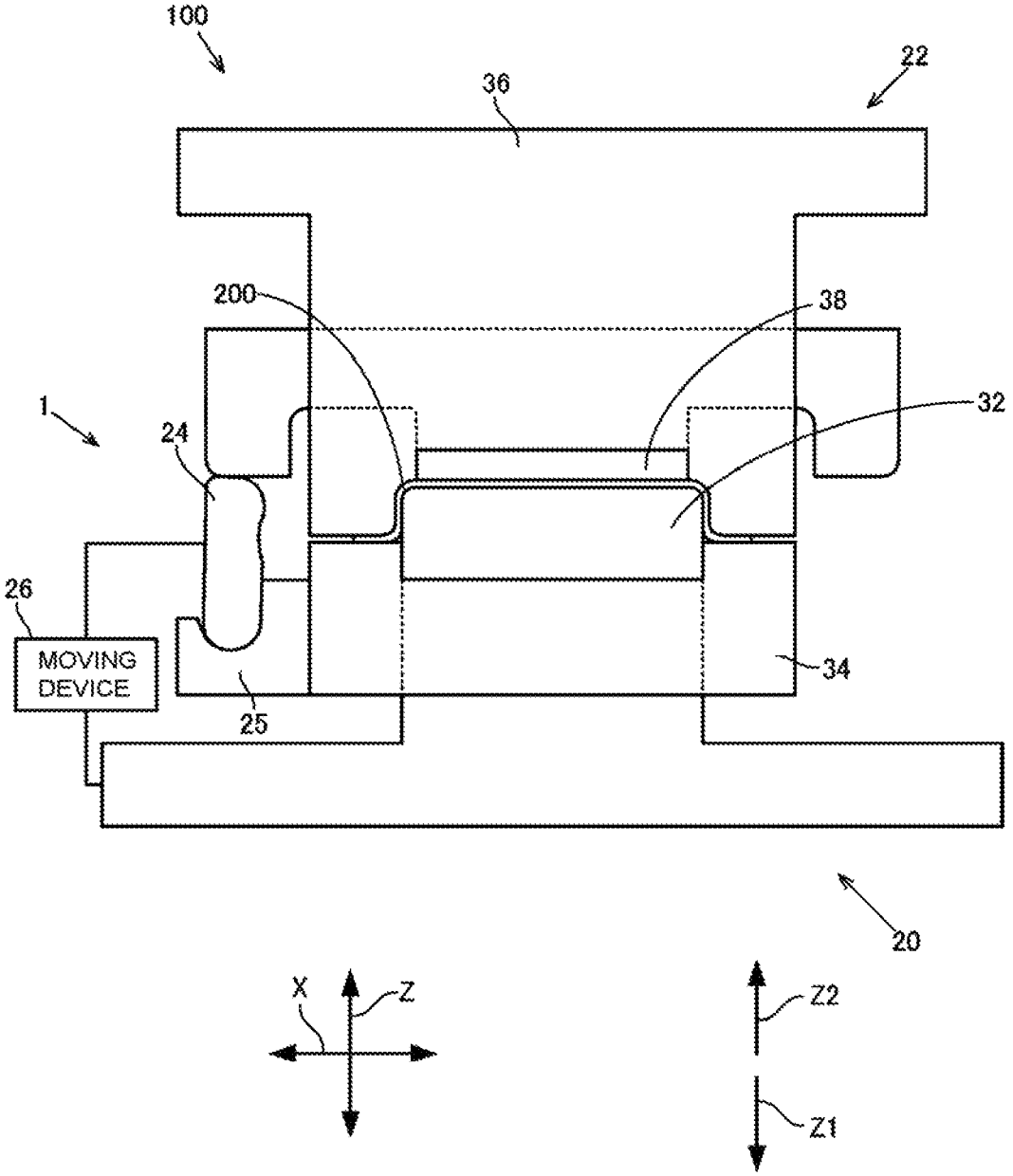

[Fig.5]
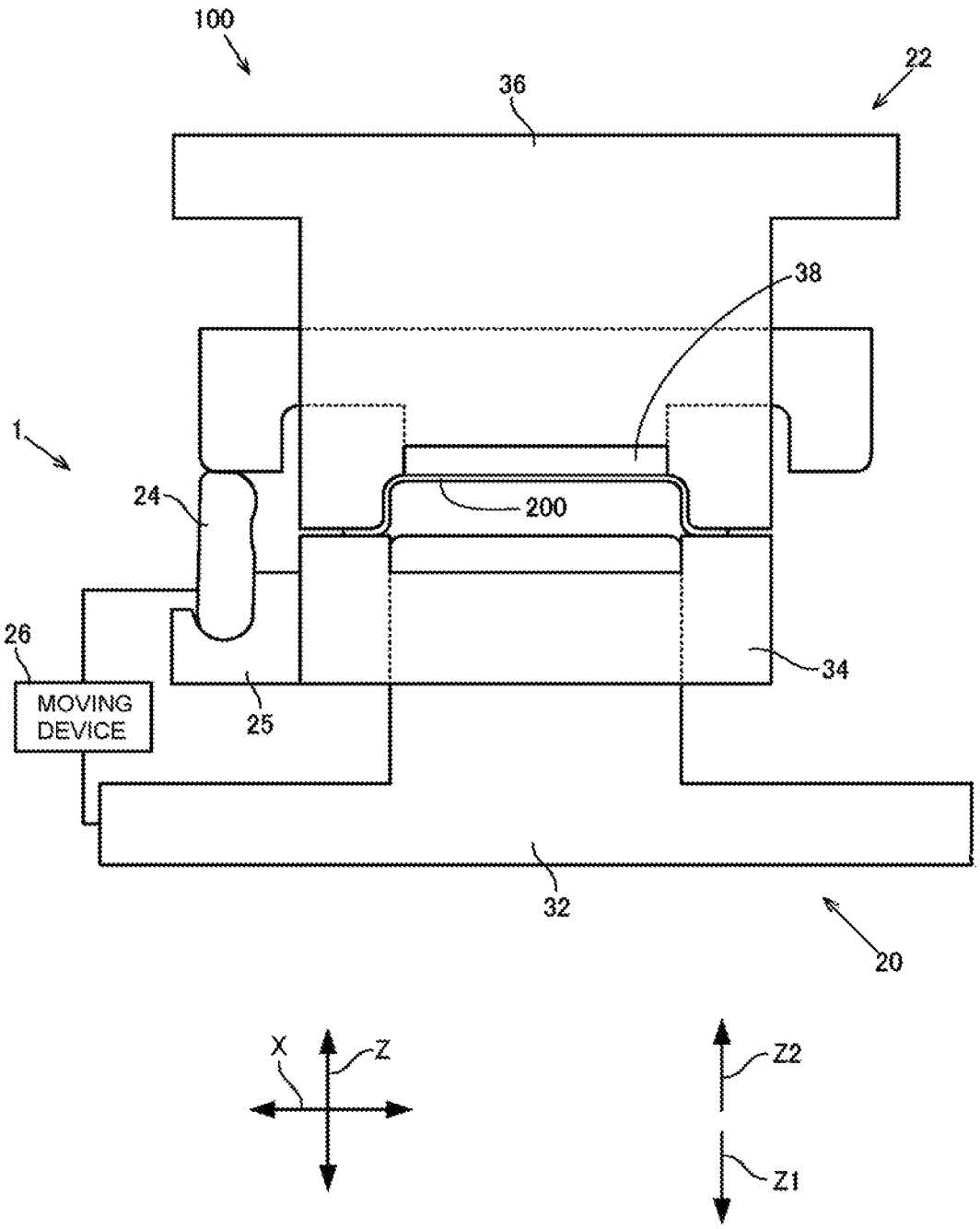

[Fig.6]
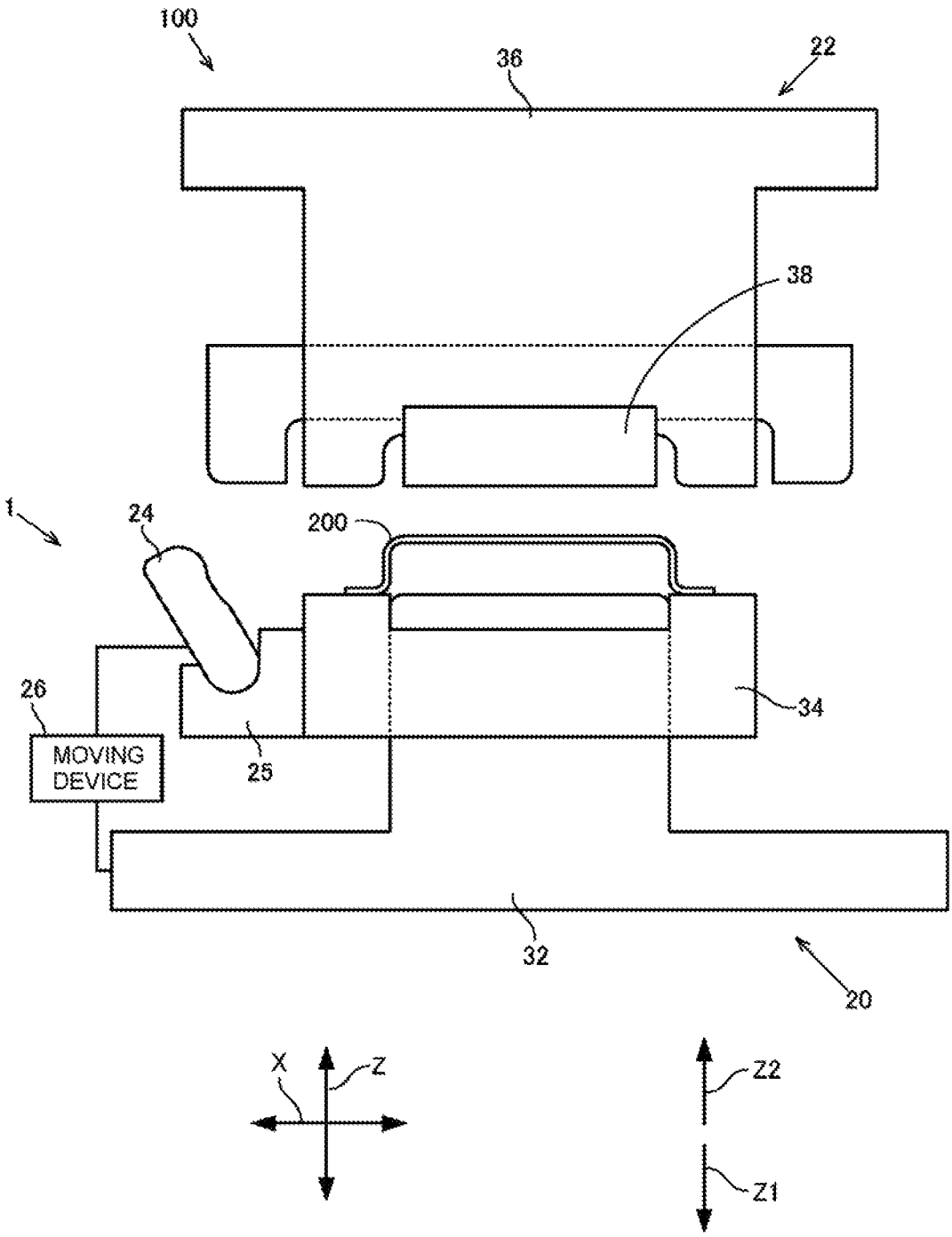

[Fig.7]
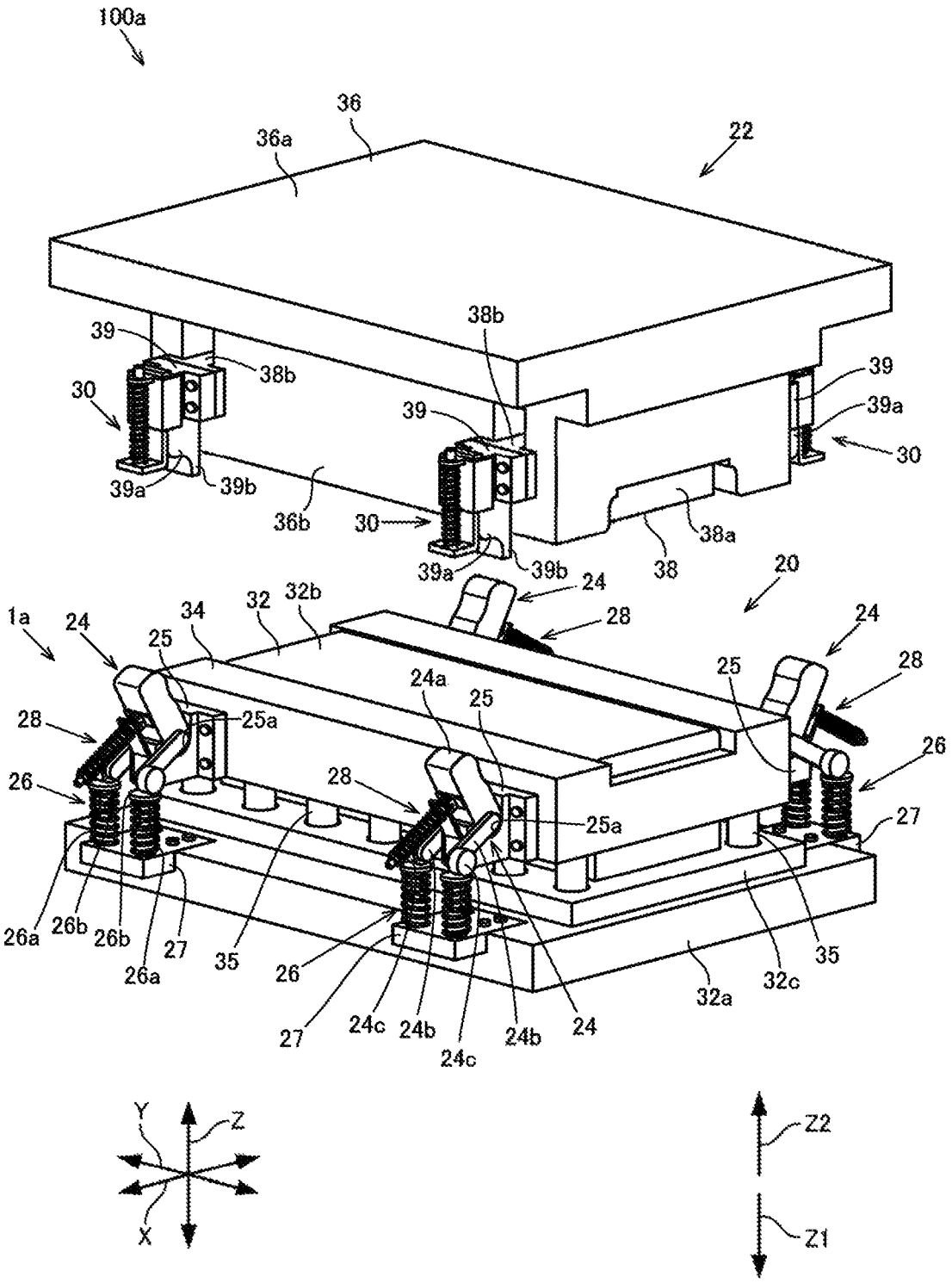

[Fig.8]
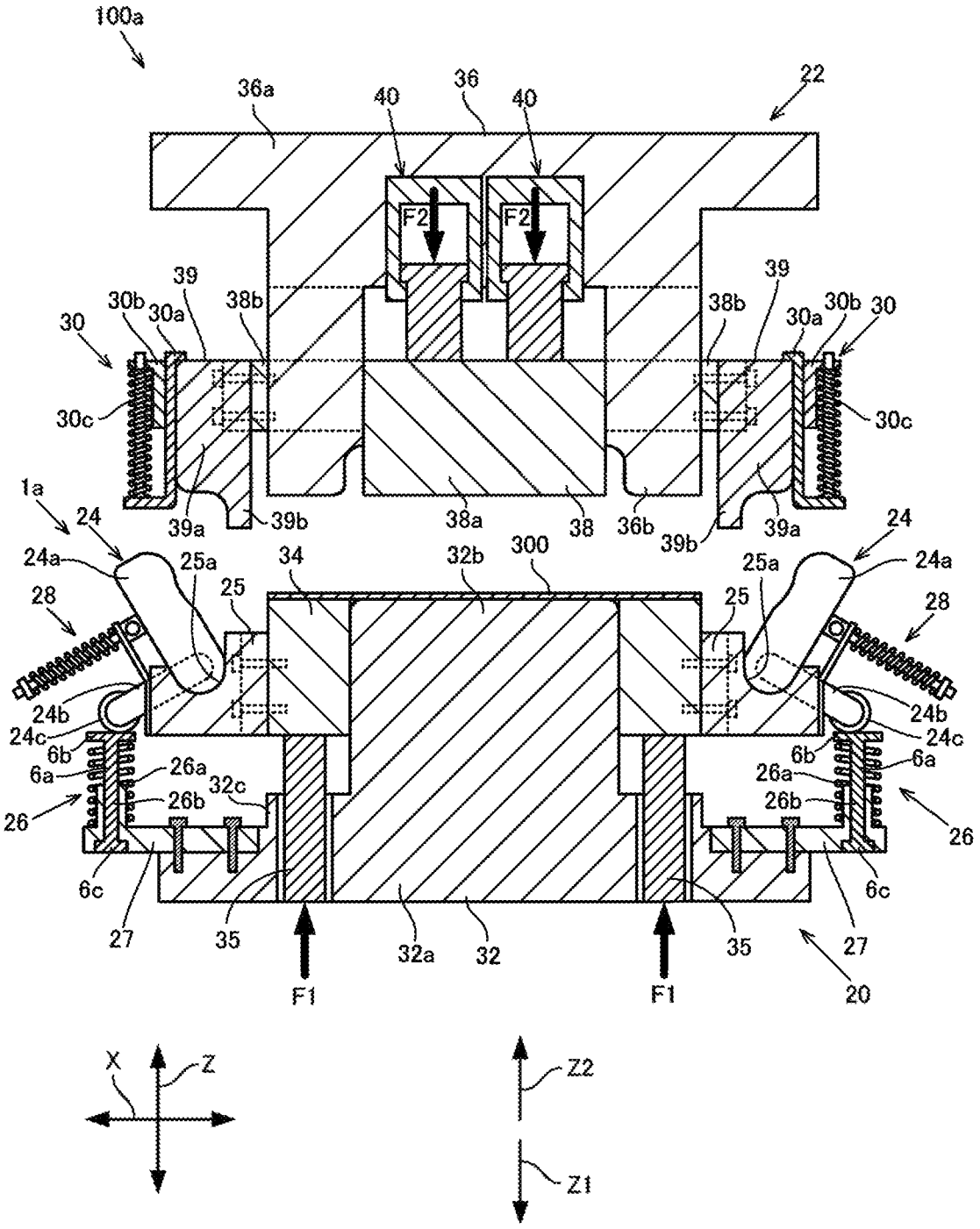

[Fig.9]
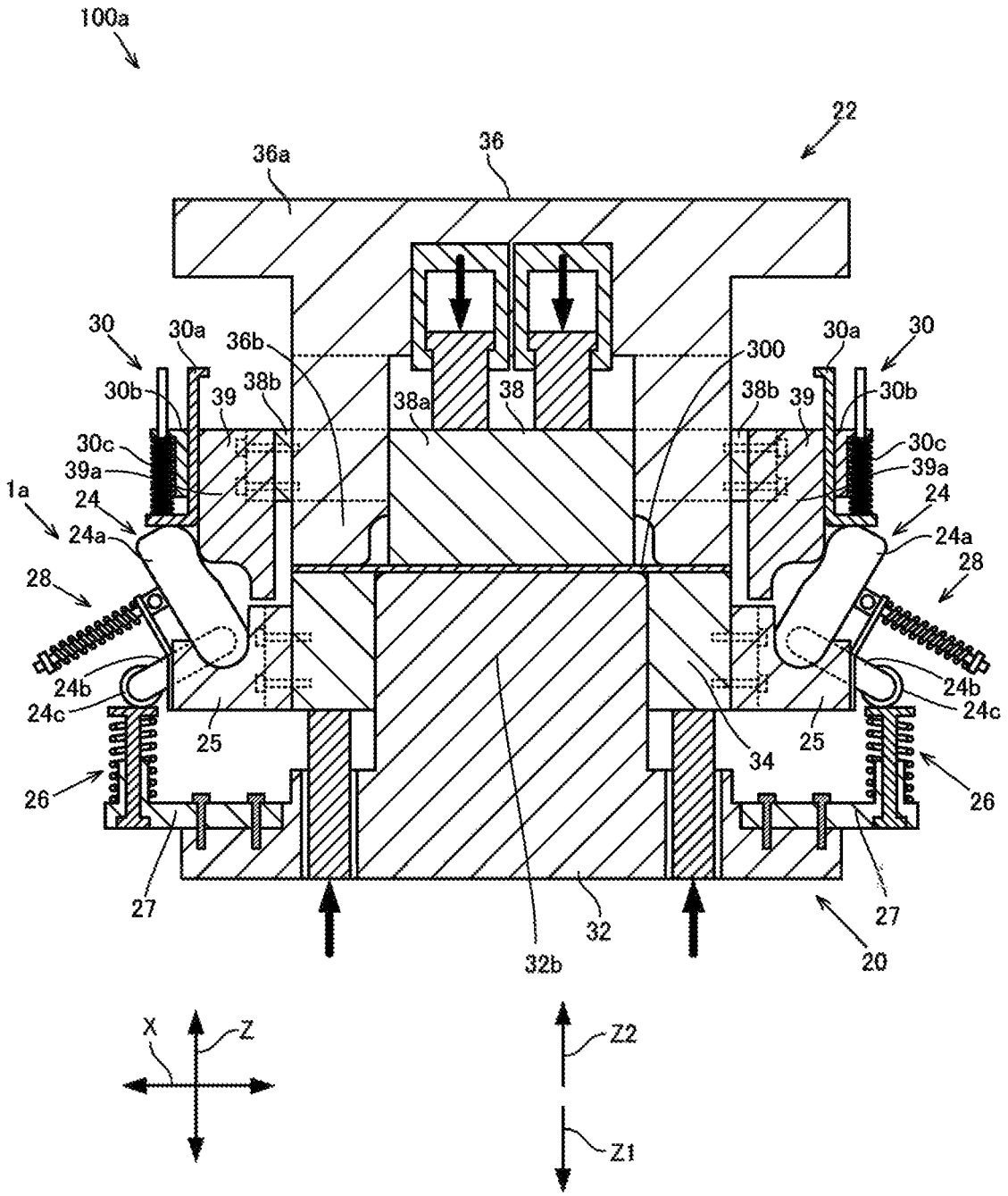

[Fig.10]
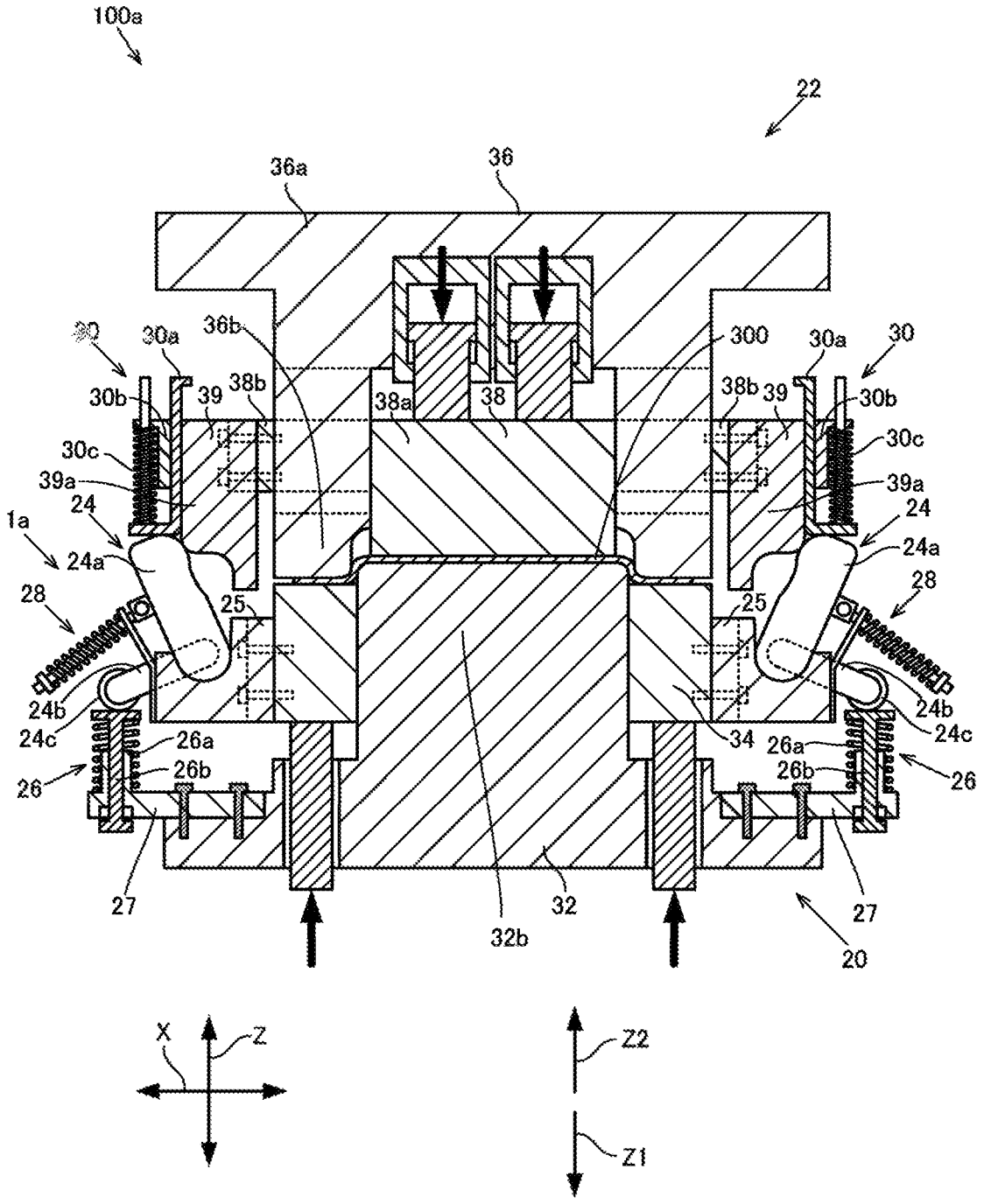

[Fig.11]
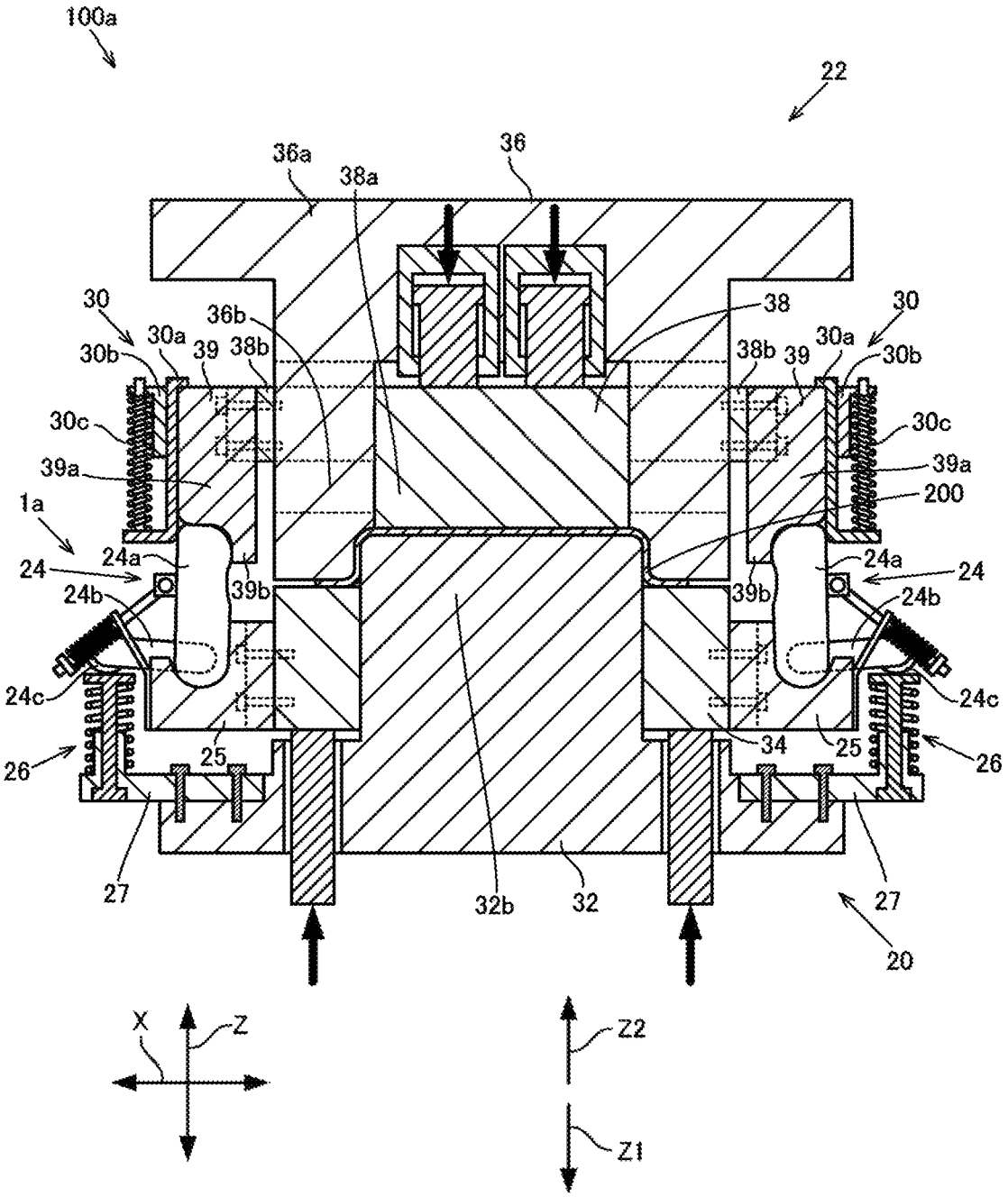

[Fig.12]
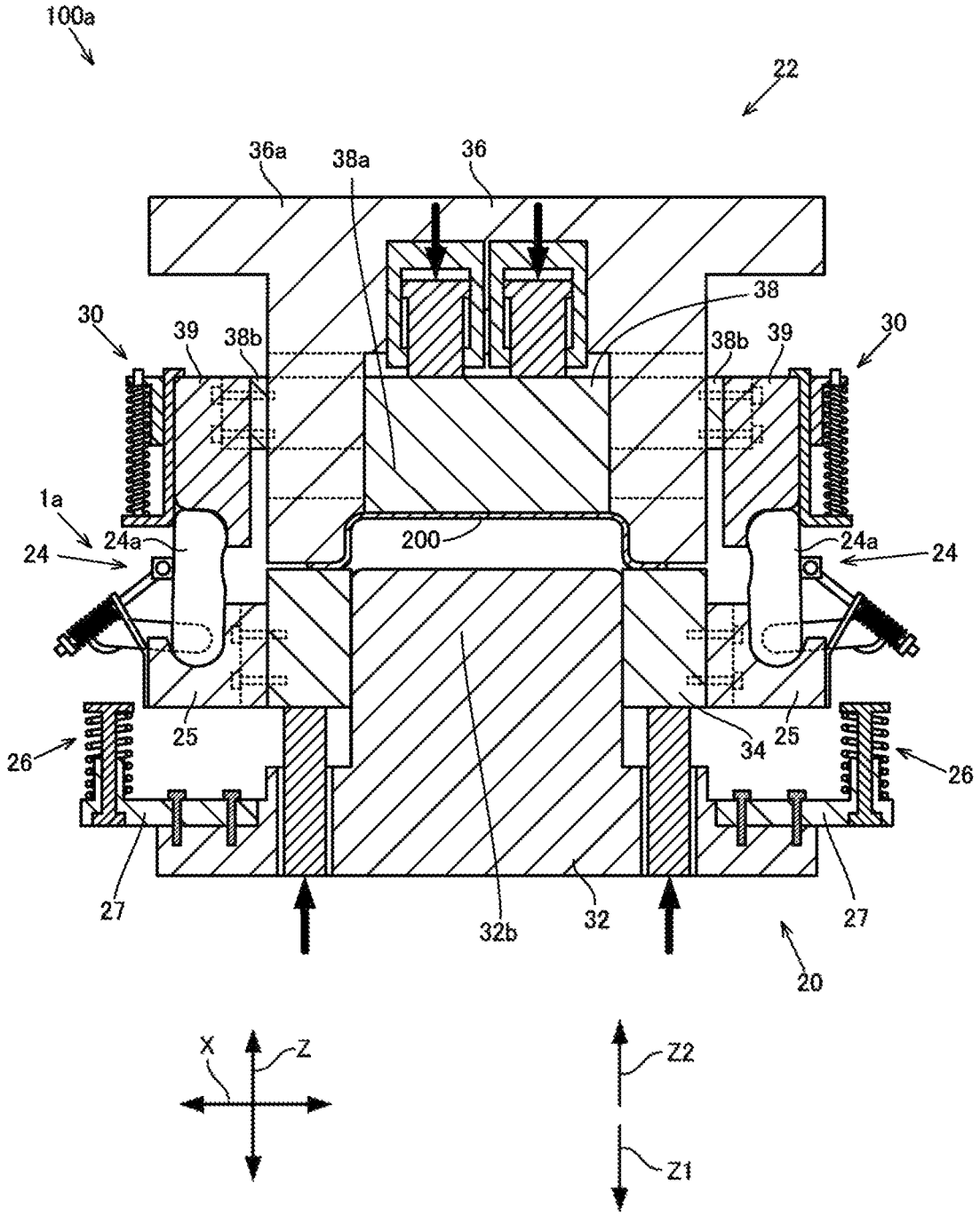

[Fig.13]
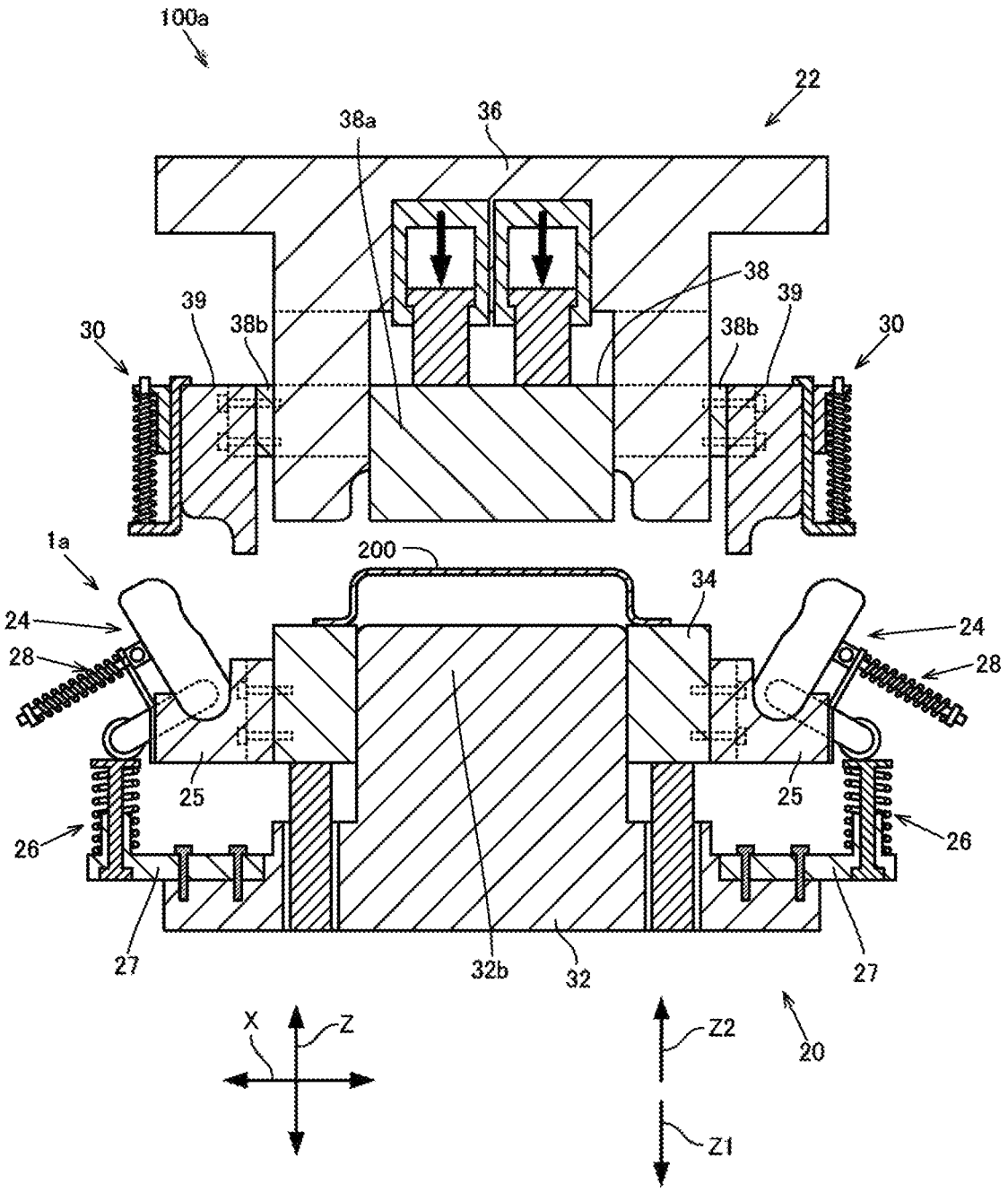

[Fig.14]
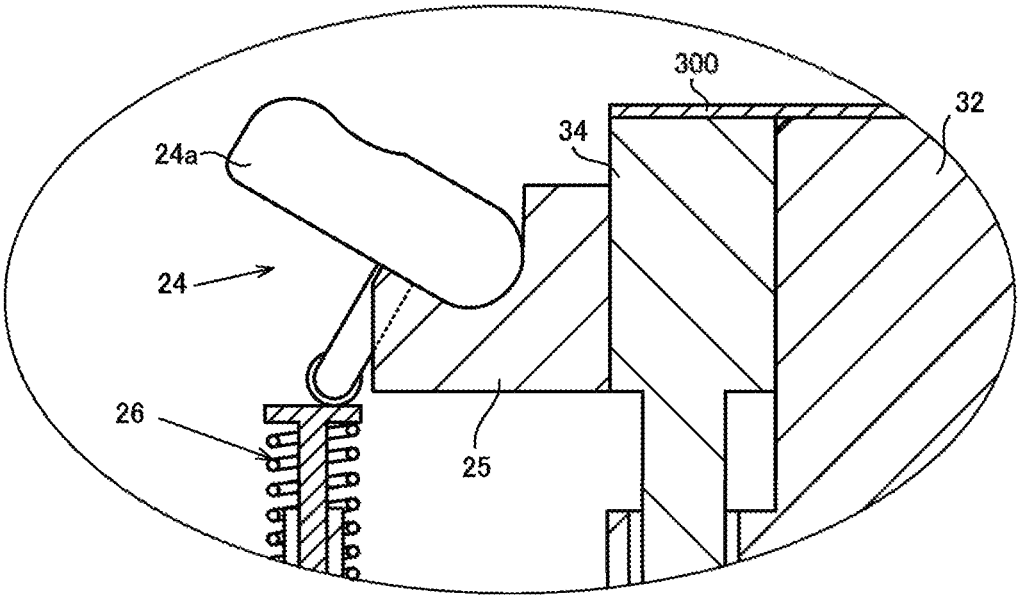
[Fig.15]
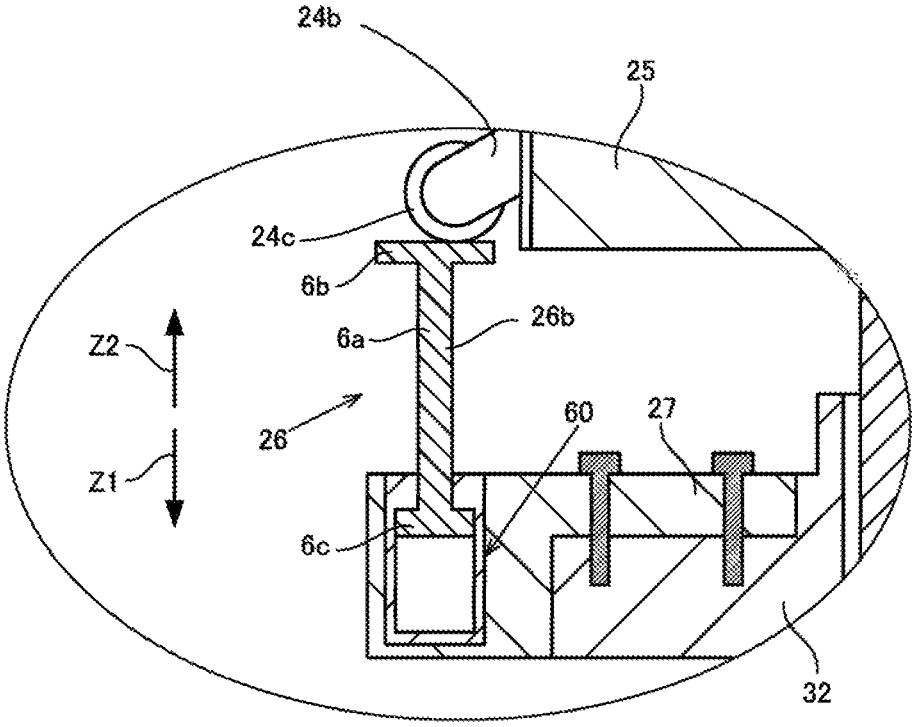

[Fig.16]
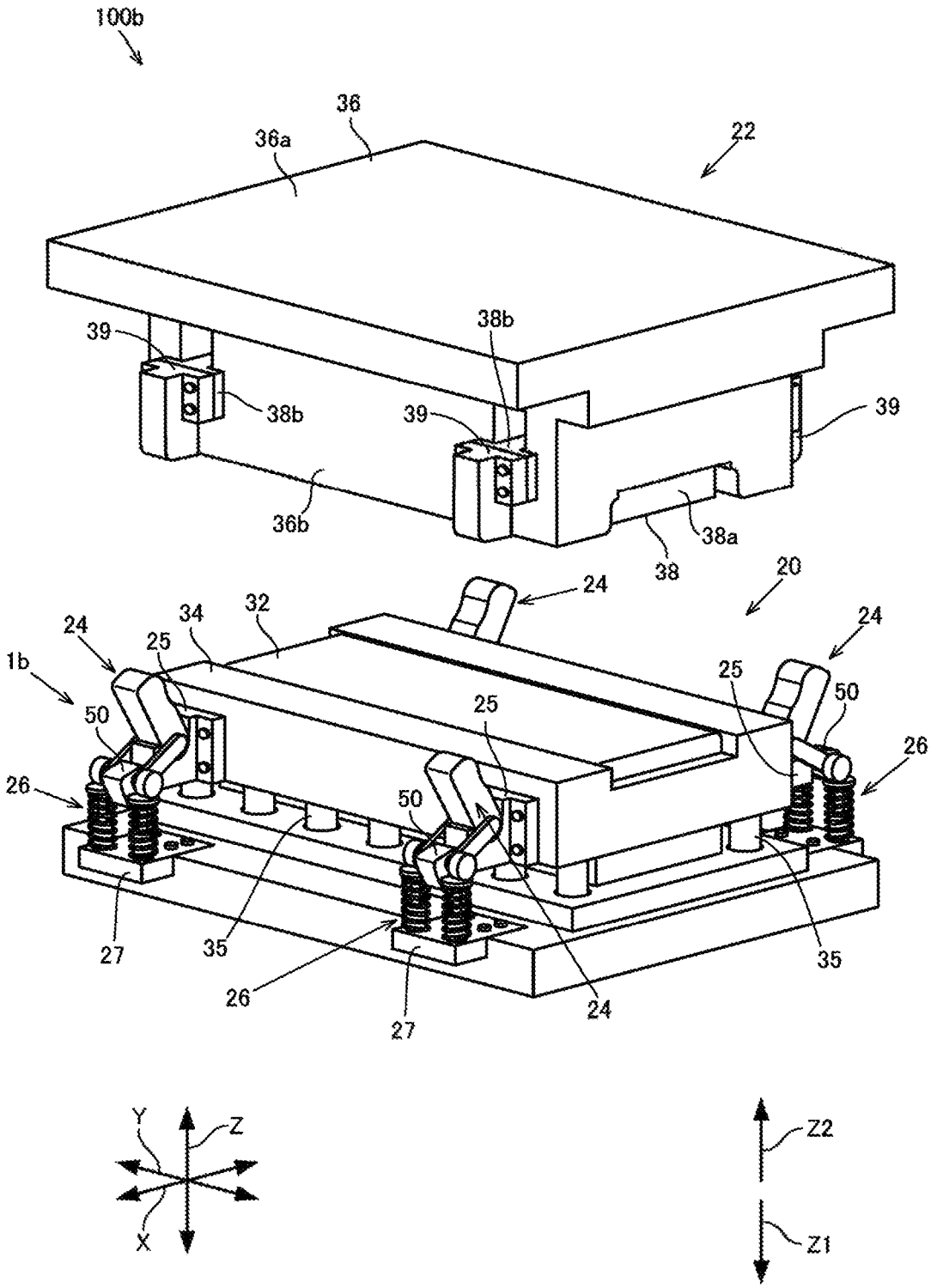

[Fig.17]
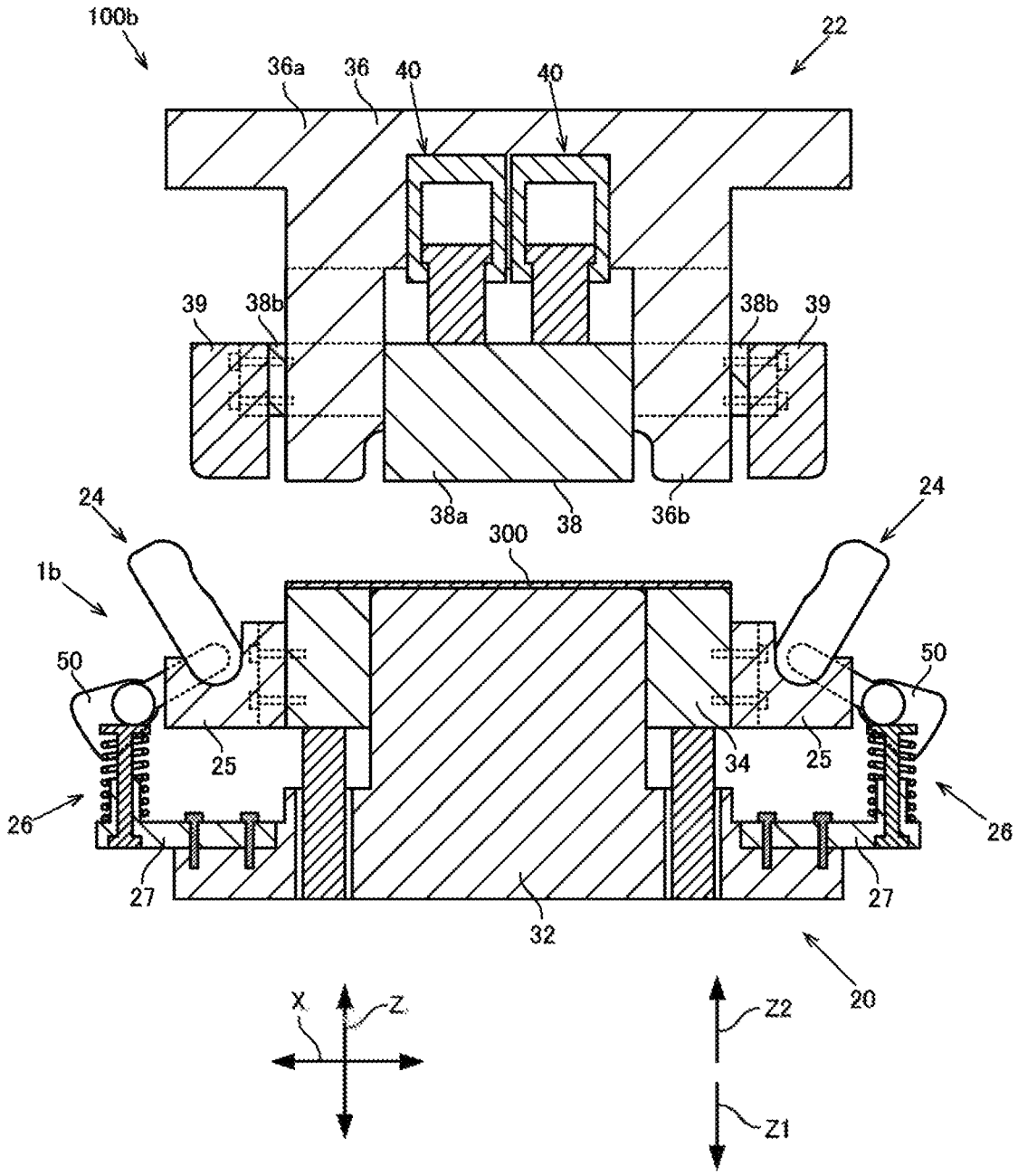

[Fig.18]
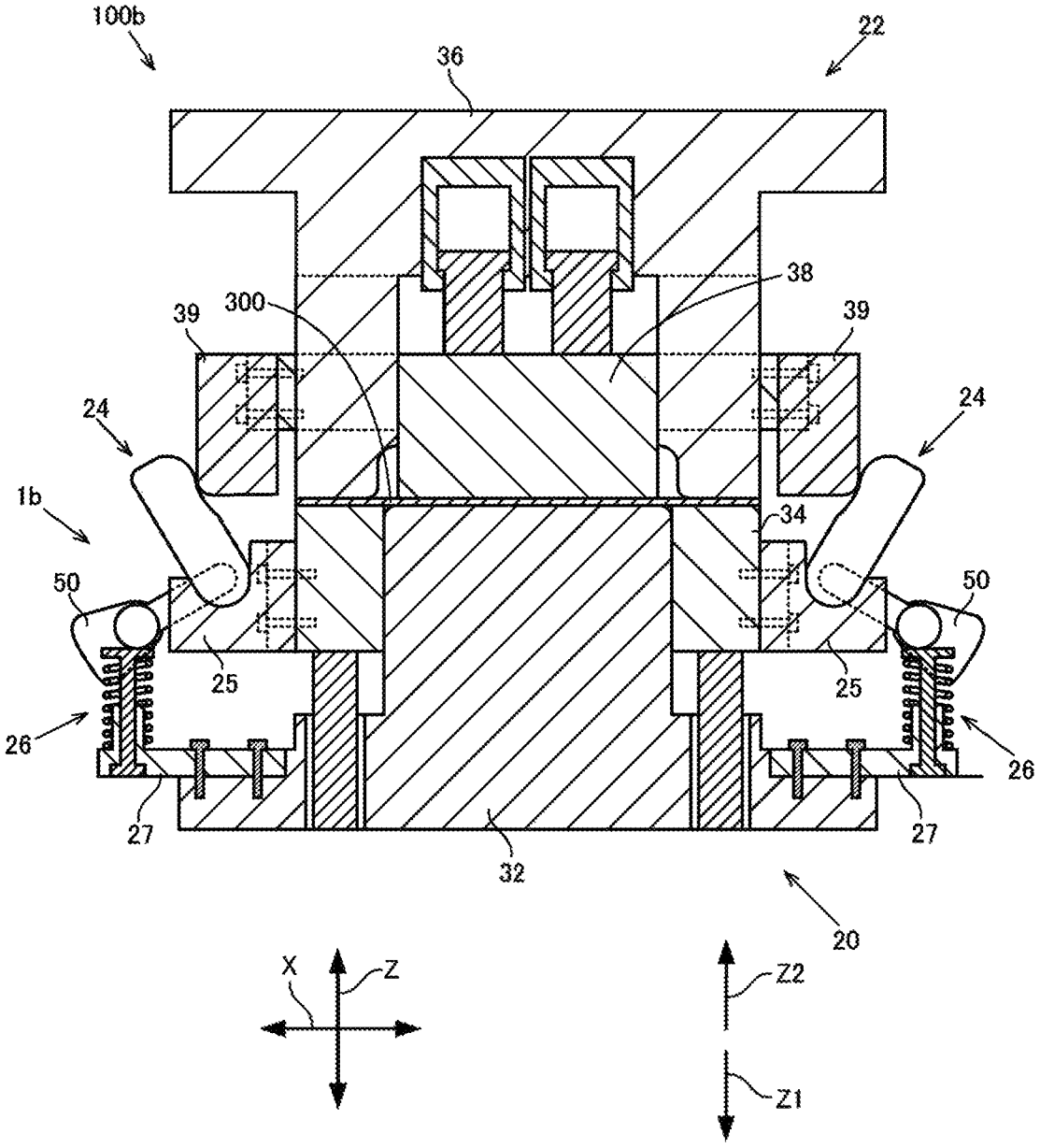

[Fig.19]
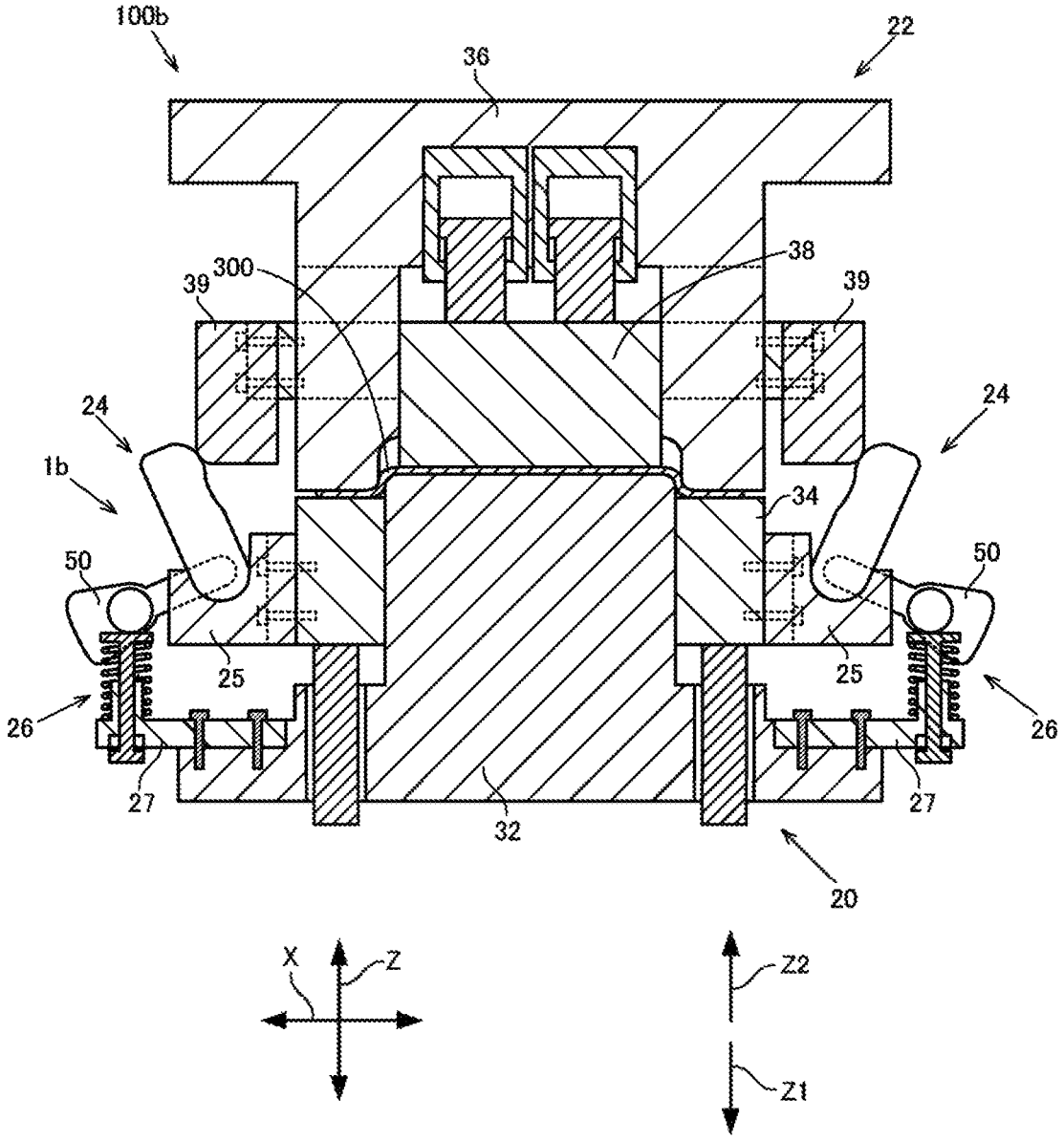

[Fig.20]
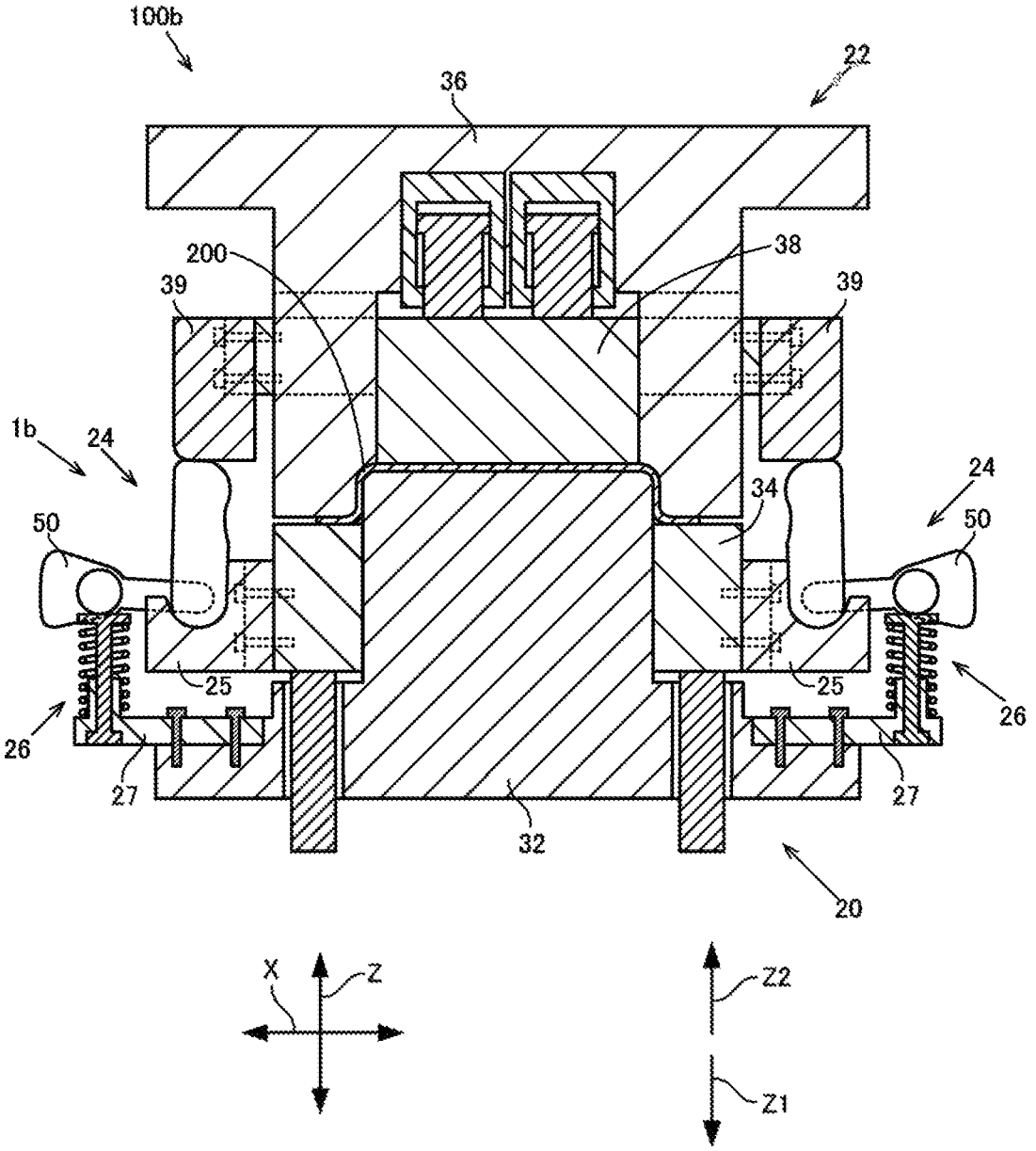

[Fig.21]
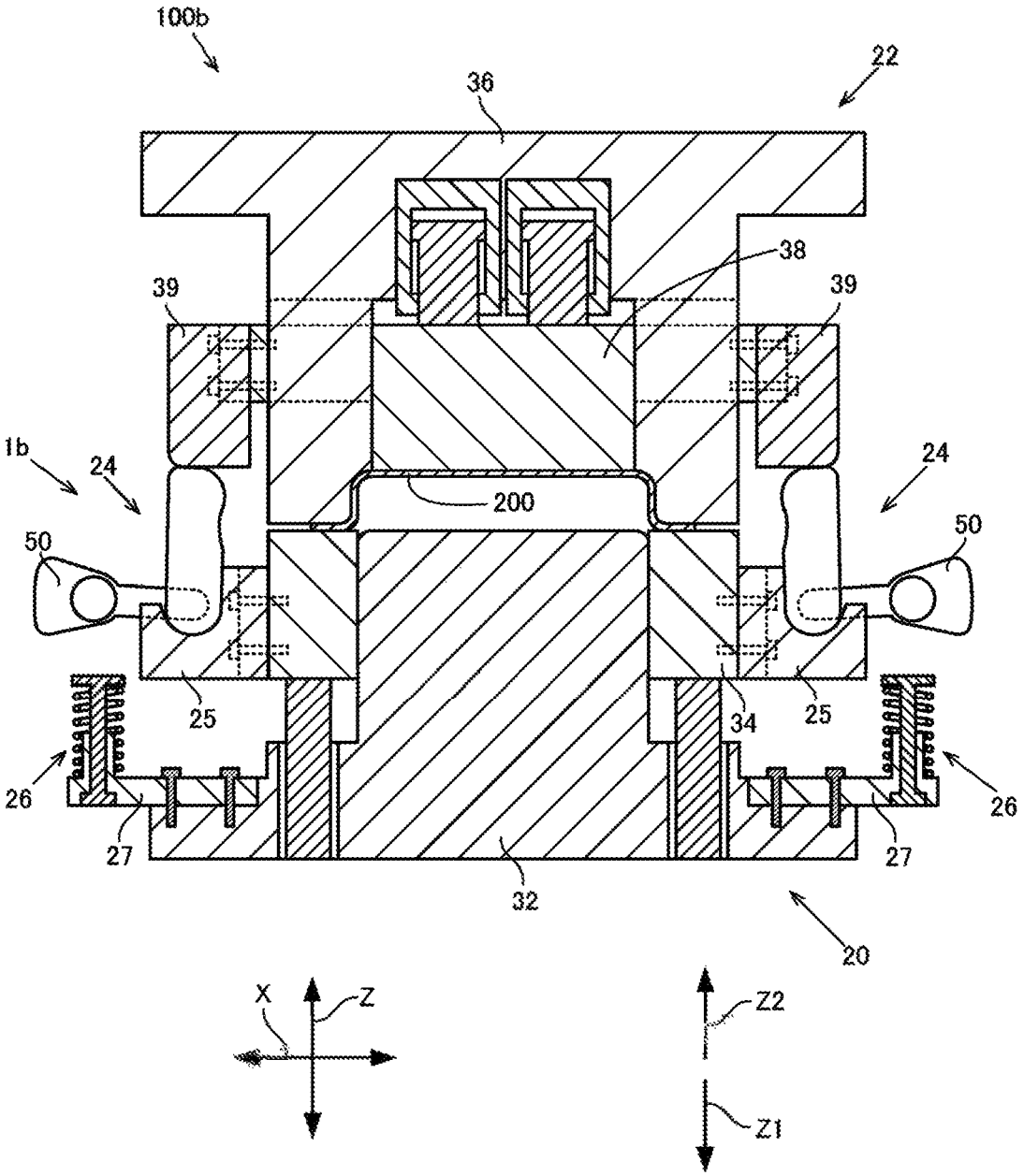

[Fig.22]
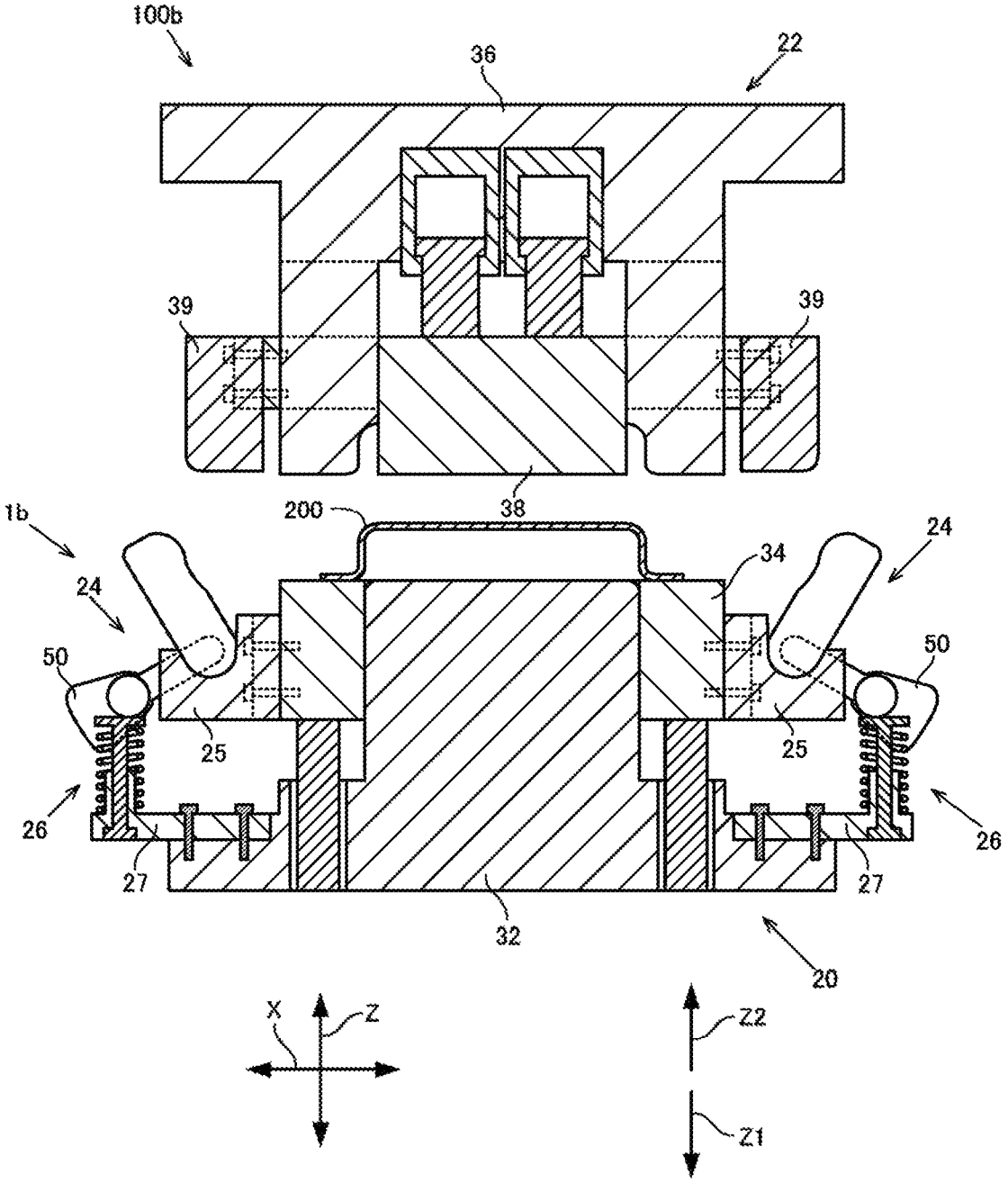

[Fig.23]
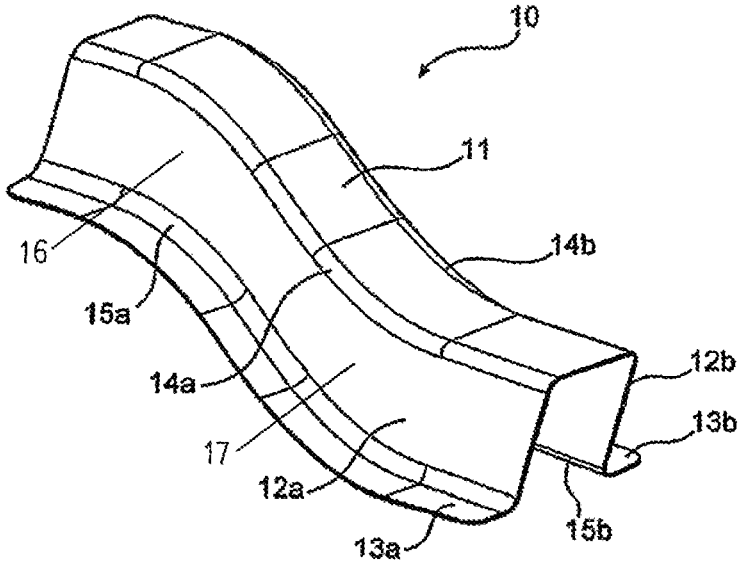
[Fig.24]
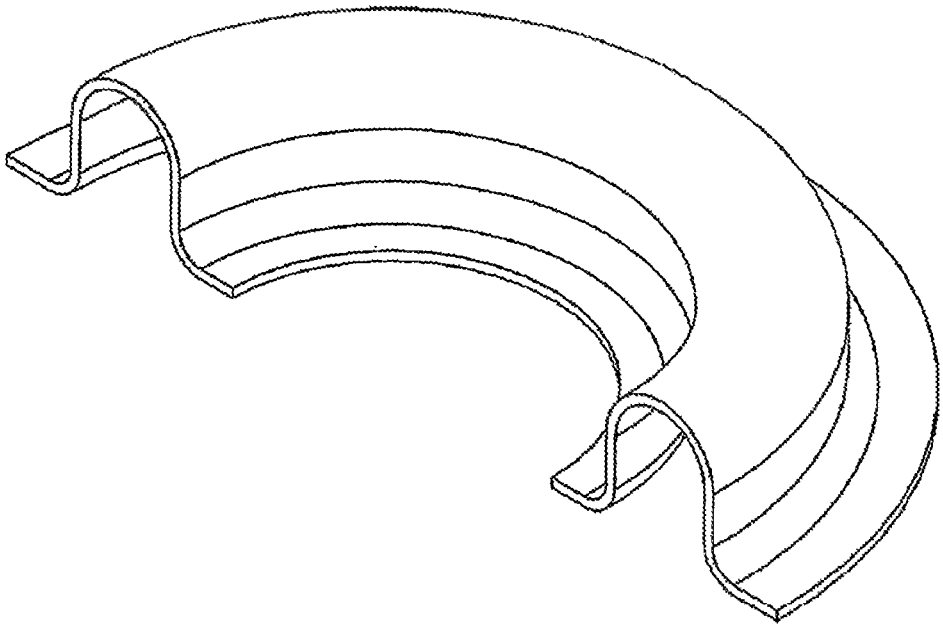

[Fig.25]
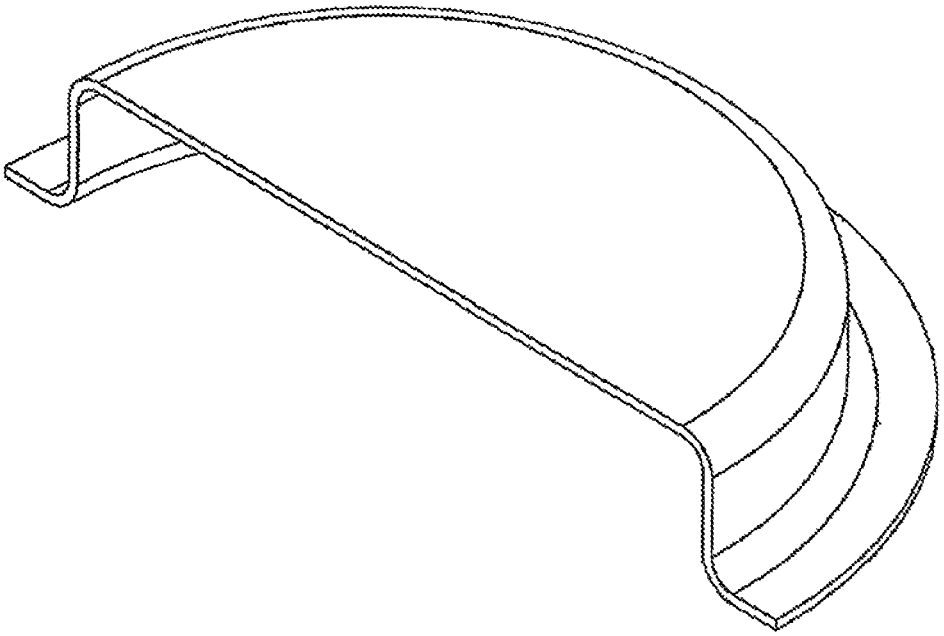
[Fig.26]
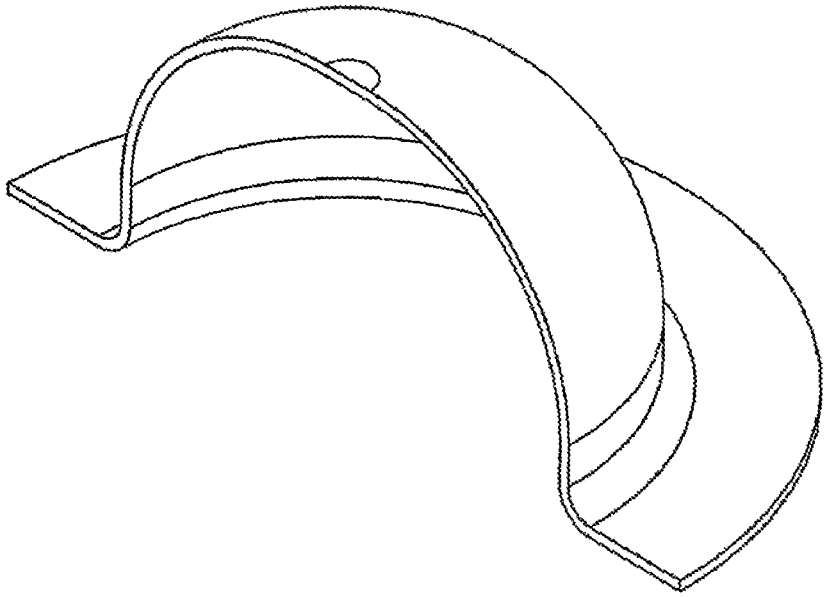

[Fig.27]
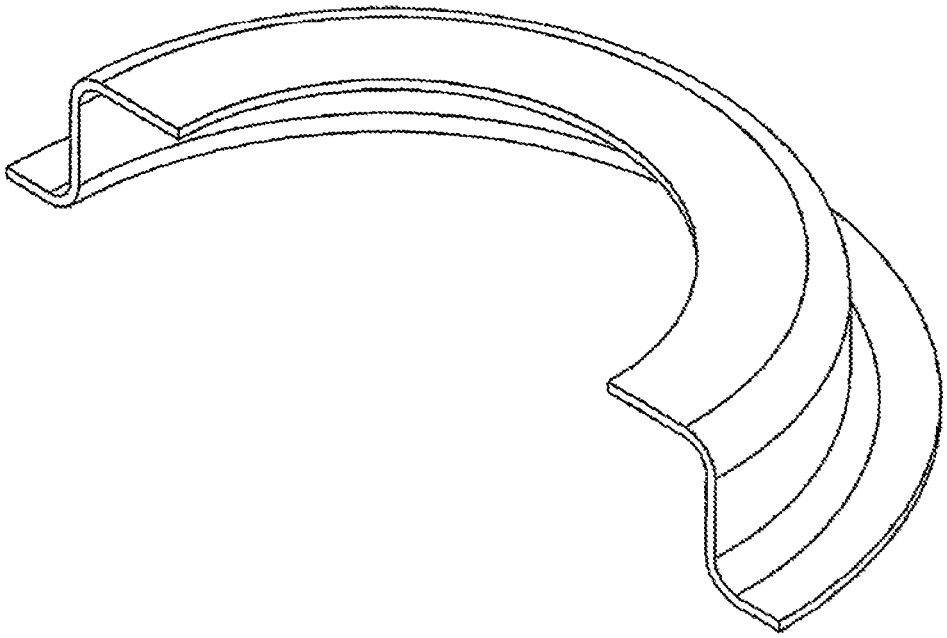
[Fig.28]
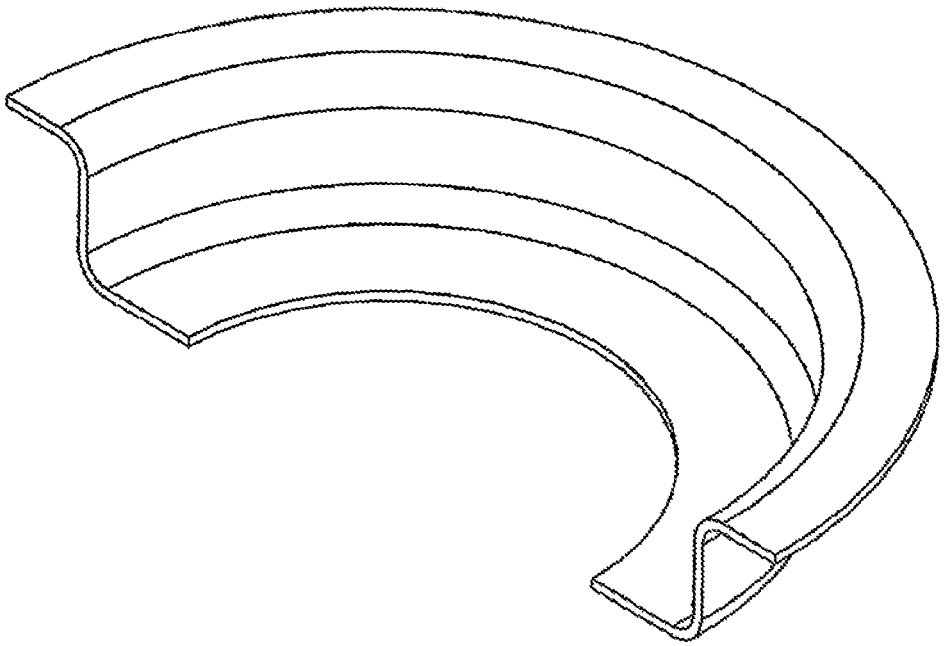

[Fig.29]
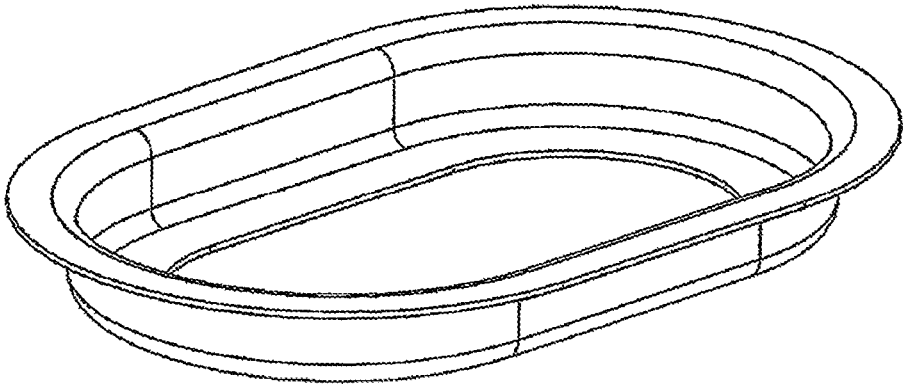
[Fig.30]
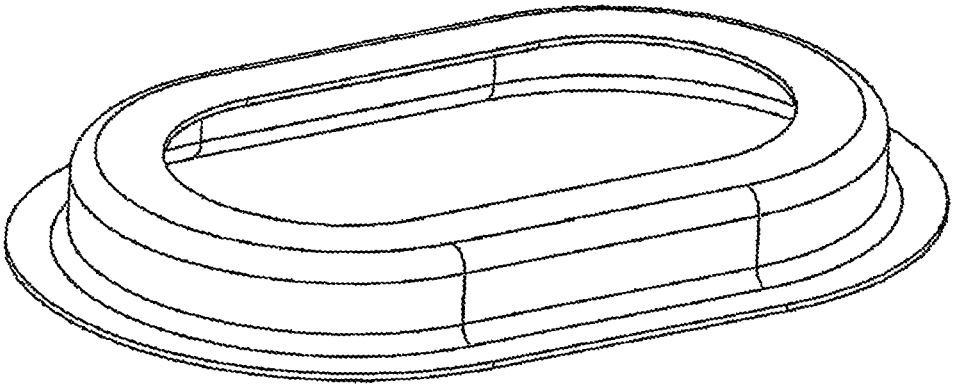
[Fig.31]
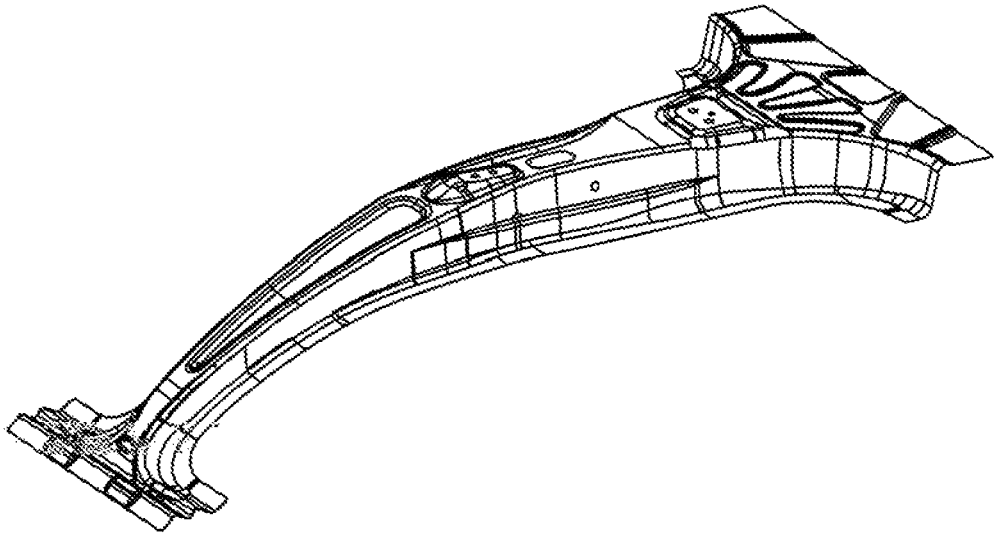

[Fig.32]
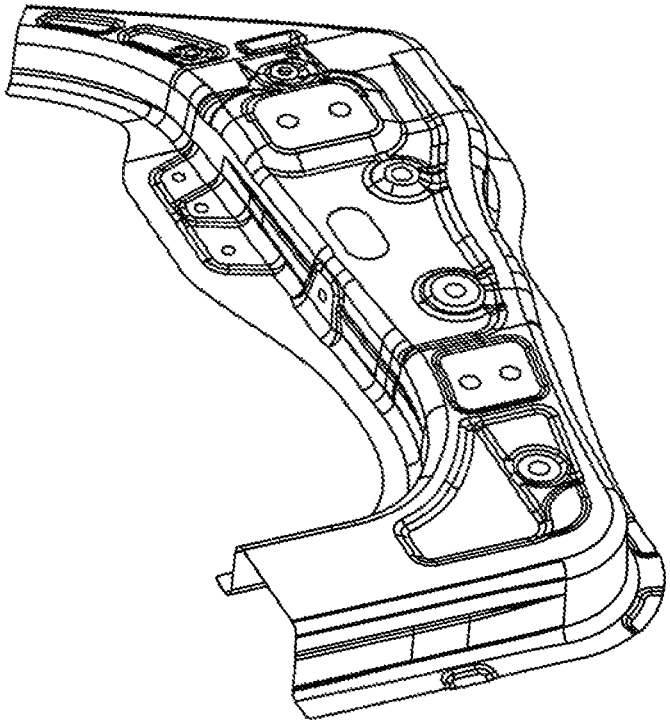
[Fig.33]
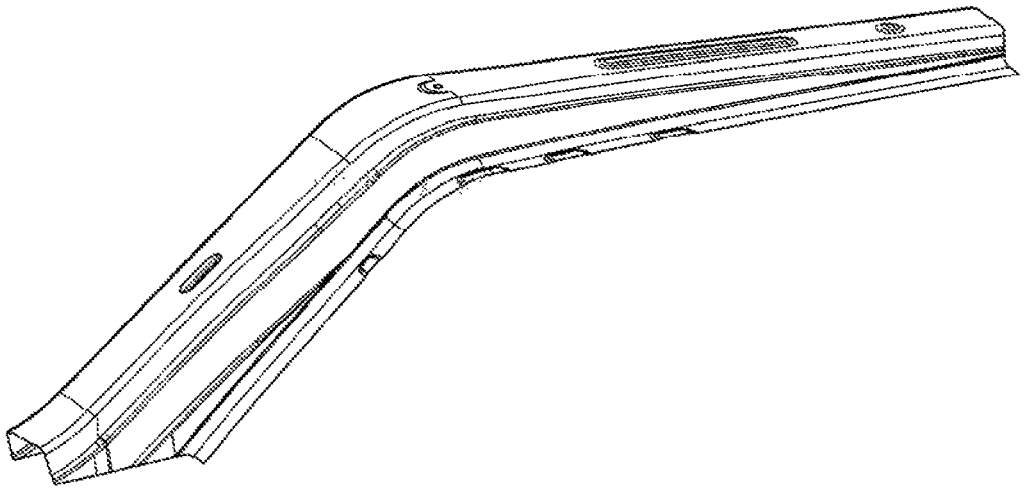

[Fig.34]
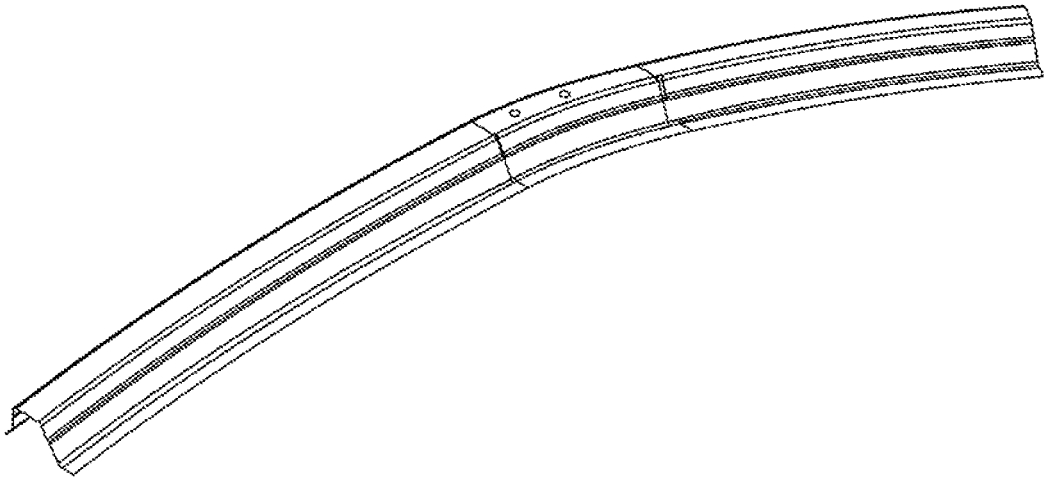

HOLD DEVICE

TECHNICAL FIELD

The present invention relates to a hold device attached to and used in a press tooling.

BACKGROUND ART

Structural members for automobile such as a front side member, a cross member, an A pillar, and a B pillar are produced by draw forming of a starting material (for example, a metal sheet). A press tooling is used for the draw forming and the press tooling is provided with an upper die set constituted of a die and a lower die set constituted of a punch and a holder.

For draw forming, for example, outer edge portions of a starting material are pressed against the die by means of the holder and a center portion of the starting material is pressed into the die by means of the punch. In this way, a formed product that has a desired shape is produced.

During the draw forming, a pressing force exerted on the die by the holder generates an inflow resistance on the outer edge portion of starting material. This enables shaping of the starting material while the starting material is tensioned and generation of a wrinkle due to a redundant material during forming can be suppressed.

In recent years, for improvement in collision safety and for weight reduction of a vehicle body, high-tensile steels that have a tensile strength of 590 MPa or more, and even 980 MPa or more are used for starting materials of structural members for automobile.

However, formability of the starting material decreases as the strength of the starting material increases. Accordingly, when a starting material constituted of the high-tensile steel is subjected to draw forming, an excessive inflow resistance generated on an outer edge portion of the starting material leads to a reduction in sheet thickness in portions of a formed product, which may lead to a crack in the formed product.

The generation of such a crack can be suppressed by reducing the pressing force by the holder to lower the inflow resistance generated on the outer edge portion of the starting material. However, when the inflow resistance generated on the outer edge portion of the starting material is lowered, the starting material cannot be properly expanded and a wrinkle due to a redundant material may be generated.

In view of this, there has conventionally be proposed a device in which cracks and wrinkles as described above can be suppressed. For example, Patent Document 1 discloses a manufacturing device for a pressed component. The manufacturing device disclosed in Patent Document 1 includes a first die set provided on a pressing machine's bolster and a second die set provided on a pressing machine's slide. The first die set includes a punch die fixed to the pressing machine's bolster and a blank holder located outside the punch die. The second die set includes a movable pad provided on the pressing machine's slide, and a bending blade located outside the movable pad, a catcher located outside the bending blade and movable along with the movable pad, and an outer cam located outside the catcher.

In the manufacturing device in Patent Document 1, the blank holder and the bending blade is used to clamp the outer edge portion of the blank while at the same time, the movable pad and the punch die are used to clamp the center of the blank. In this state, draw forming is performed by pressing the center of the blank by the punch die toward the bending blade. In this case, deformation in a thickness direction is suppressed during forming in a portion clamped by the movable pad and the punch die. In this way, generation of a wrinkle can be suppressed in the portion clamped by the movable pad and the punch die without unnecessarily increasing the pressing force by the blank holder. In this way, generation of a crack and a wrinkle can be suppressed in the formed product.

In the above-described manufacturing device, it is necessary to cause the first die set and the second die set to release from each other to take out the formed product after draw forming. However, even after the press forming, the movable pad and the blank holder are each subjected to a force that moves them toward each other. Accordingly, simply causing the first die set and the second die set to release from each other leads to deformation of the formed product during the release due to pressure from the movable pad and the blank holder.

To prevent such deformation of the formed product, the manufacturing device of Patent Document 1 is provided with a joint link pivotably supported by the blank holder. Specifically, in the manufacturing device of Patent Document 1, the joint link and the catcher are engaged with each other at a forming bottom dead center so that the movable pad and the blank holder are prevented from moving closer to each other. As a result, it is possible to prevent deformation of the formed product during the release due to pressure from the movable pad and the blank holder.

LIST OF PRIOR ART DOCUMENTS

Patent Document

Patent Document 1: JP2017-170482A

SUMMARY OF INVENTION

Technical Problem

To bring the joint link and the catcher into engagement in the manufacturing device in Patent Document 1, it is necessary to move an outer cam of the second die set toward the first die set to bring the outer cam into contact with the joint link so that the joint link is turned inward of the die set.

It has been found in a detailed study conducted by the present inventors that in the manufacturing device in Patent Document 1, the joint link and the outer cam are prone to deterioration. Specifically, in the manufacturing device in Patent Document 1, since the joint link is provided on the first die set and the outer cam is provided on the second die set, the distance between the center of gravity of the joint link and the center of gravity of the outer cam is large. This makes it difficult to improve the relative positional accuracy between the joint link and the outer cam, and thus a load in a direction unconsidered in design may in some cases be imposed on the joint link and the outer cam when the joint link and the outer cam are brought into contact. Consequently, the joint link and the outer cam are likely to be damaged. As a result, it is difficult to reduce maintenance costs of the manufacturing device.

An objective of the present invention is to provide a hold device that makes it possible to suppress deformation of the formed product during the release while suppressing maintenance costs.

Solution to Problem

The gist of the present invention is a hold device as described below.

(1) A hold device attached to and used in a press tooling, wherein the press tooling includes: a first die unit that has a punch and a holder; and a second die unit that has a pad disposed to face the punch and a die disposed to face the holder, the first die unit and the second die unit move closer relative to each other in a press direction to perform press forming on a sheet-like material placed between the first die unit and the second die unit, the holder is provided in a movable manner with respect to the punch in the press direction, and the pad is provided in a movable manner with respect to the die in the press direction, wherein the hold device includes:

a distance member pivotably attached to the holder; and a moving device attached to the first die unit such that the distance member attached to the holder is pivotable, and wherein in the press direction, when a direction from the second die unit to the first die unit is defined as a first direction and a direction opposite to the first direction is defined as a second direction, and in a state in which the distance member and the moving device is attached to the press tooling, the distance member is pivotable between a home position in which the distance member does not come into contact with the second die unit and a preventive position in which a distance between the pad and the holder in the press direction is prevented from being equal to or less than a predetermined distance, and as the holder moves relative to the punch in the first direction, the moving device causes the distance member to pivot from the home position toward the preventive position.

(2) The hold device according to the aspect (1), wherein the distance member is directly or indirectly subjected to a load in the first direction from the pad in the preventive position to prevent the distance between the pad and the holder in the press direction from being equal to or less than the predetermined distance.

(3) The hold device according to the aspect (2), wherein the moving device transmits a force for pivoting the distance member to the distance member at a position different from a position where the distance member is directly or indirectly subjected to the load from the pad.

(4) The hold device according to the aspect (3), wherein in the distance member, a distance between the position where the distance member is subjected to the load and a pivoting center is larger than a distance between the position where the force is transmitted from the moving device and the pivoting center.

(5) The hold device according to the aspect (3), wherein in the distance member, a distance between the position where the distance member is subjected to the load and a pivoting center is equal to or less than a distance between the position where the force is transmitted from the moving device and the pivoting center.

(6) The hold device according to any one of the aspects (1) to (5), wherein the moving device includes a repulsive-force generator, and is directly or indirectly fixed to the punch, the distance member presses the repulsive-force generator in the first direction as the holder moves relative to the punch in the first direction, the repulsive-force generator is pressed by the distance member in the first direction to thereby generate a repulsive force in the second direction, and the distance member pivots from the home position toward the preventive position upon receipt of the repulsive force in the second direction from the repulsive-force generator.

(7) The hold device according to any one of the aspects (1) to (6), further including:

a supporting member that pivotably supports the distance member, wherein the distance member is attached to the holder via the supporting member.

(8) The hold device according to any one of the aspects (1) to (7), further including:

a receiving member that is fixed to the pad such that the receiving member is not in contact with the distance member in the home position and comes into contact with the distance member in the preventive position, wherein the distance member is subjected to the load in the first direction from the pad via the receiving member in the preventive position to thereby prevent the distance between the pad and the holder in the press direction from being equal to or less than the predetermined distance.

Advantageous Effects of Invention

According to the present invention, it is possible to suppress deformation of the formed product during the release while suppressing maintenance costs.

BRIEF DESCRIPTION OF DRAWINGS

FIG. 1 is a schematic configuration view of a press tooling including a hold device according to an embodiment of the present invention attached thereto.

FIG. 2 illustrates operation of the hold device and the press tooling in FIG. 1.

FIG. 3 illustrates operation of the hold device and the press tooling in FIG. 1.

FIG. 4 illustrates operation of the hold device and the press tooling in FIG. 1.

FIG. 5 illustrates operation of the hold device and the press tooling in FIG. 1.

FIG. 6 illustrates operation of the hold device and the press tooling in FIG. 1.

FIG. 7 is a perspective view illustrating a specific configuration of a press tooling including a hold device according to an embodiment of the present invention attached thereto.

FIG. 8 is a sectional view illustrating an internal structure of the hold device and the press tooling in FIG. 7.

FIG. 9 illustrates operation of the hold device and the press tooling in FIG. 7.

FIG. 10 illustrates operation of the hold device and the press tooling in FIG. 7.

FIG. 11 illustrates operation of the hold device and the press tooling in FIG. 7.

FIG. 12 illustrates operation of the hold device and the press tooling in FIG. 7.

FIG. 13 illustrates operation of the hold device and the press tooling in FIG. 7.

FIG. 14 illustrates a variation of a moving part.

FIG. 15 illustrates a variation of a moving device.

FIG. 16 is a perspective view illustrating a press tooling including a hold device according to another embodiment of the present invention attached thereto.

FIG. 17 is a sectional view illustrating an internal structure of the hold device and the press tooling in FIG. 16.

FIG. 18 illustrates operation of the hold device and the press tooling in FIG. 16.

FIG. 19 illustrates operation of the hold device and the press tooling in FIG. 16.

FIG. 20 illustrates operation of the hold device and the press tooling in FIG. 16.

FIG. 21 illustrates operation of the hold device and the press tooling in FIG. 16.

FIG. 22 illustrates operation of the hold device and the press tooling in FIG. 16.

FIG. 23 illustrates an example of a pressed component.

FIG. 24 illustrates a doughnut-shaped component.

FIG. 25 illustrates a cylindrical component.

FIG. 26 illustrates a spherical component.

FIG. 27 illustrates a ring-shaped component.

FIG. 28 illustrates a ring-shaped component.

FIG. 29 illustrates a ring-shaped component.

FIG. 30 illustrates a ring-shaped component.

FIG. 31 illustrates a B pillar.

FIG. 32 illustrates an A pillar lower.

FIG. 33 illustrates a front side member.

FIG. 34 illustrates a roof rail.

DESCRIPTION OF EMBODIMENTS (Outline of Press Tooling)

A hold device according to an embodiment of the present invention and a press tooling including the hold device attached thereto will now be described with reference to drawings. FIG. 1 is a schematic configuration view of the hold device according to an embodiment of the present invention and the press tooling. FIGS. 2 to 6 illustrate operation of the hold device and the press tooling in FIG. 1. In FIGS. 1 to 6, arrows that indicate an x-direction and a z-direction, respectively, are applied, and the arrows perpendicularly intersect with each other. In the specification, the x-direction is the width direction of the press tooling. The z-direction is the up-down direction. In the following, the x-direction is denoted as a width direction X, and the z-direction is denoted as an up-down direction Z.

As illustrated in FIG. 1, a press tooling 100 includes a first die (lower die) unit 20 and a second die (upper die) unit 22. Although a detailed description is omitted, the press tooling 100 is attached to and utilized in, for example, a known pressing machine, which is not illustrated. A hold device 1 according to an embodiment of the present invention is attached to the first die unit 20. As described in detail later, the hold device 1 includes a distance member 24, a supporting member 25, and a moving device 26. In the following, although a description will be made as to the hold device 1 and the press tooling 100 for producing a pressed component 200 that has a hat shape in cross section (see FIG. 6 as described later) from a sheet-like material 300, pressed components produced by using the hold device 1 according to the present invention are not limited to the pressed component 200 illustrated in FIG. 6. The configuration and operation of the hold device according to the present invention, and the configuration and operation of the press tooling to which the hold device according to the present invention is attached are not limited to those of the embodiments described later, and the configuration and operation of the hold device and the press tooling may be altered as necessary depending on shapes of pressed components to be produced.

The first die unit 20 and the second die unit 22 are disposed to face each other in the up-down direction Z. The press tooling 100 according to the embodiment is a device for subjecting the sheet-like material 300 placed between the first die unit 20 and the second die unit 22 to press forming by moving the first die unit 20 and the second die unit 22 closer relative to each other in the press direction.

In the embodiment, the up-down direction Z corresponds to the press direction. Further, in the embodiment, a direction in the press direction from the second die unit 22 toward the first die unit 20 is defined as a first direction Z1, and a direction from the first die unit 20 toward the second die unit 22 is defined as a second direction Z2.

The first die unit 20 includes a punch 32 and a holder 34. The second die unit 22 includes a die 36 and a pad 38. In the up-down direction Z, the die 36 is provided to face the holder 34 and the pad 38 is provided to face the punch 32. The holder 34 is provided in a movable manner with respect to the punch 32 in the up-down direction Z, and the pad 38 is provided in a movable manner with respect to the die 36 in the up-down direction Z.

The distance member 24 of the hold device 1 is attachable to and removable from the holder 34. In the embodiment, the distance member 24 is used by being attached to the holder 34 in a pivotable manner via the supporting member 25. More specifically, the distance member 24 is pivotably supported by the supporting member 25 and the supporting member 25 is attached to the holder 34. The distance member 24 is moved in the up-down direction Z along with movement of the holder 34 in the up-down direction Z.

In the embodiment, the distance member 24 is attached to the holder 34 such that the distance member 24 can be caused to pivot between a home position (position illustrated in FIG. 1) in which the distance member 24 does not come into contact with the second die unit 22 and a preventive position (positions illustrated in FIGS. 4 and 5) described later. As described in detail later, in the home position, the distance member 24 is not loaded from the second die unit 22. On the other hand, in the preventive position, the distance member 24 is loaded from the pad 38 of the second die unit 22 in the first direction Z1.

The moving device 26 is attachable to and removable from the first die unit 20. In the embodiment, the moving device 26 is used by being attached to the first die unit 20 such that the distance member 24 can be caused to pivot. The moving device 26 is a device for causing the distance member 24 to pivot from the home position (position illustrated in FIG. 1) toward the preventive position (positions illustrated in FIGS. 4 and 5) as the holder 34 moves relative to the punch 32 in the first direction Z1. In FIG. 1, although the moving device 26 is attached to the punch 32, the moving device 26 may be attached to any component of the first die unit 20.

A brief description will now be made as to an example of operation of the hold device 1 and the press tooling 100 during press forming on the material 300. When the press tooling 100 including the hold device 1 attached thereto is used to perform press forming, as illustrated in FIG. 1, the sheet-like material 300 is first placed on the punch 32 and the holder 34. At this time, the first die unit 20 is separated from the second die unit 22 in the up-down direction Z. In FIG. 1, constituent members of the hold device 1 and the press tooling 100 are in the home position. Note that the distance member 24 is away from the second die unit 22 in the home position. In other words, in the home position, the distance member 24 is not loaded from the second die unit 22.

Next, as illustrated in FIGS. 2 and 3, the first die unit 20 and the second die unit 22 move toward each other in the up-down direction Z. Specifically, as illustrated in FIG. 2, the die 36 of the second die unit 22 moves relative to the first die unit 20 in the first direction Z1. In this way, the material 300 is clamped between the punch 32 and the holder 34, and the pad 38 and the die 36. Note that in FIG. 2, the distance member 24 is in the home position.

As illustrated in FIG. 3, the die 36 moves further relative to the first die unit 20 in the first direction Z1, so that the holder 34 and the die 36 move relative to the punch 32 and the pad 38 in the first direction Z1. In this way, shaping of the material 300 is started.

As illustrated in FIG. 4, the holder 34 and the die 36 move further in the first direction Z1 with respect to the punch 32 and the pad 38 and reach a forming bottom dead center (forming-completion position). As a result, the pressed component 200 that has a predetermined forming height is obtained. Further, as illustrated in FIGS. 3 and 4, as the holder 34 moves relative to the punch 32 in the first direction Z1, the moving device 26 of the hold device 1 causes the distance member 24 to pivot from the home position toward the preventive position.

In the state illustrated in FIG. 4, the pad 38 is constrained from moving relative to the holder 34 in the first direction Z1 by the distance member 24. In this way, the distance between the holder 34 and the pad 38 in the up-down direction Z is maintained at or larger than the predetermined forming height. In other words, in the state illustrated in FIG. 4, the distance between the holder 34 and the pad 38 in the up-down direction Z is prevented from being equal to or less than a predetermined distance by the distance member 24. In the embodiment, the preventive position refers to a position of the distance member 24 (position illustrated in FIG. 4) in which the distance between the holder 34 and the pad 38 in the up-down direction Z is prevented from being equal to or less than a predetermined distance. In the preventive position, the distance member 24 is connected to the pad 38, so that the distance member 24 is loaded from the pad 38 in the first direction Z1. Note that in FIG. 4, although the distance member 24 is in contact with the pad 38 in the preventive position, the distance member 24 may be connected indirectly to the pad 38 via any other member. In other words, the distance member 24 may be loaded from the pad 38 in the first direction Z1 directly from the pad 38 or indirectly via any other member. In the following, a function of the hold device for preventing the distance between the holder and the pad from being equal to or less than a predetermined distance will be referred to as a locking function and an action of the hold device to prevent the distance between the holder and the pad from being equal to or less than a predetermined distance will be referred to as a locking action.

Next, as illustrated in FIG. 5, the holder 34 and the pad 38 move along with the die 36 relative to the punch 32 in the second direction Z2. As a result, the punch 32 moves relative to the pad 38 in the first direction Z1. In other words, the punch 32 moves in a direction away from the pad 38.

Finally, as illustrated in FIG. 6, the first die unit 20 and the second die unit 22 are further separated away from each other in the up-down direction Z, and the pressed component 200 is taken out. Here, as described above, the distance between the holder 34 and the pad 38 in the up-down direction Z is maintained at or larger than a predetermined forming height by the distance member 24 of the hold device 1. In other words, the pressure applied from the holder 34 in the second direction Z2 and the pressure applied from the pad 38 in the first direction Z1 are both received by the distance member 24. In this way, a large pressure can be prevented from being applied to the pressed component 200 from the holder 34 and the pad 38. As a result, during the release, it is possible to prevent deformation of the pressed component 200.

As described above, in the hold device 1 according to the embodiment, both the distance member 24 and the moving device 26 are configured to be attached to the first die unit 20. Accordingly, it is possible to reduce the distance between the center of gravity of the distance member 24 and the center of gravity of the moving device 26 in the up-down direction Z as compared to a case in which the moving device 26 is attached to the second die unit 22. In this way, when the distance member 24 and the moving device 26 are to be attached to the first die unit 20, relative positional accuracy between the distance member 24 and the moving device 26 can be improved. Accordingly, when a force is transmitted from the moving device 26 to the distance member 24 (when the distance member 24 is caused to pivot), it is possible to sufficiently suppress a load in a direction unconsidered in design on the distance member 24 and the moving device 26. As a result, it is possible to sufficiently suppress a damage on the distance member 24 and the moving device 26. In other words, maintenance costs of the hold device 1 can be suppressed.

Further, since the distance between the center of gravity of the distance member 24 and the center of gravity of the moving device 26 is reduced, it is possible to cause the distance member 24 to pivot with a small action of the moving device 26. Accordingly, the moving device 26 itself can be constructed in a small size. In this case, the distance between the center of gravity of the moving device 26 and an attachment position of the moving device 26 to the first die unit 20 can be reduced. In this way, a moment of a force applied from the distance member 24 to the moving device 26 when the force is transmitted from the moving device 26 to the distance member 24 can be reduced. As a result, it is possible to sufficiently suppress a damage on the moving device 26.

Further, since the moving device 26 can be smaller, the assembly precision of the moving device 26 to the first die unit 20 can be improved. In this way, when the distance member 24 comes into contact with the moving device 26, it is possible to suppress an unnecessary load due to misalignment on the distance member 24 and the moving device 26. As a result, the distance member 24 can be caused to smoothly pivot with a small power, and it is possible to sufficiently suppress a damage on the distance member 24 and the moving device 26.

Further, since the operational range and configuration of the moving device 26 can be smaller, the degree of design freedom of the press tooling 100 itself increases. In this way, even for a transfer-type pressing machine, which is highly demanding with respect to dimensions and configuration of exterior portions of the press tooling, it is possible to properly utilize the hold device 1.

Further, the hold device 1 according to the embodiment is attachable to and removable from the press tooling 100. Accordingly, with provision of a spare for the hold device 1, even when any of components in the hold device 1 fails, the spare for the hold device 1 can be substituted therefor to continue the operation of the press tooling 100. For example, even when unexpected failure occurs in the hold device 1, the hold device 1 can be replaced, so that the failure can be rapidly addressed.

Further, in the embodiment, the hold device 1 provides the locking function. Accordingly, by properly adjusting the hold device 1 when the hold device 1 is to be assembled to the press tooling 100, making adjustment to the locking action is facilitated when the press tooling 100 is to be assembled to a pressing machine.

Further, in the embodiment, the press tooling 100 only needs to be configured such that the hold device 1 is attachable to and removable from the press tooling 100, so that essential portions of the press tooling 100 can be constructed by using a configuration of a known press tooling. For example, simple machining on an existing press tooling 100 for attaching the hold device 1 can allow the existing press tooling 100 to be used with the hold device 1 attached thereto. In this way, production costs of the press tooling 100 can be suppressed.

Further, in the embodiment, assembly adjustment can be performed on the hold device 1 independent of assembly adjustment of the press tooling 100 onto a pressing machine. For example, before the press tooling 100 is assembled to the pressing machine, the hold device 1 can be assembled to the press tooling 100. In this way, the assembly precision of the hold device 1 can easily be improved.

Further, since the hold device 1 can be removed from the press tooling 100, the hold device 1 can easily be maintained.

Further, in the embodiment, in occasions such as when the press tooling is to be updated or when the configuration of the press tooling is to be changed, all or some of components of the hold device 1 can be reused. In this way, running costs can be reduced.

Further, in the embodiment, for designing the press tooling 100, no detailed consideration on the locking function is required, even though considerations on arrangement, attachment structures and the like for the hold device 1 are needed. Further, in the embodiment, for example, depending on predetermined conditions such as a press load, hold devices 1 can be serialized and design data for a plurality of the hold devices 1 can be maintained on a series basis. In this case, for example, after the press tooling 100 is designed, a suitable hold device 1 can be selected from a series corresponding to the press tooling 100 in accordance with dimensions or the like of the material 300. In this way, a combination of the hold device 1 and the press tooling 100 can properly and easily be made. As a result, design man-hours for the press tooling 100 can be reduced, as compared to a case in which the hold device 1 and the press tooling 100 are designed in an integral manner.

(Specific Configuration of Hold Device and Press Tooling)

A specific configuration of a hold device according to an embodiment of the present invention and a press tooling including the hold device attached thereto will now be described with reference to drawings. FIG. 7 is a perspective view illustrating a specific configuration of a hold device according to an embodiment of the present invention and a press tooling including the hold device attached thereto. In FIG. 7, arrows that indicate an x-direction, a y-direction, and a z-direction, respectively, are applied, and the arrows perpendicularly intersect with one another. In the specification, the x-direction is the width direction of the press tooling, and the y-direction is the length direction of the press tooling. The z-direction is the up-down direction. In the following, the x-direction is denoted as a width direction X, the y-direction is denoted as a length direction Y, and the z-direction is denoted as an up-down direction Z. In the subsequent FIGS. 8 to 13, arrows that indicate the width direction X and the up-down direction Z are also indicated.

FIG. 8 is a sectional view illustrating an internal structure of the press tooling in FIG. 7. In FIG. 8 and subsequent FIGS. 9 to 13 illustrate cross sections perpendicular to the length direction of the press tooling.

In the following, as an example, a hold device 1*a* and a press tooling 100*a* for producing the pressed component 200 that has a hat shape in cross section (see FIG. 13 as described later) will be described.

As illustrated in FIGS. 7 and 8, the press tooling 100*a* includes the first die (lower die) unit 20, the second die (upper die) unit 22, and a stopper device 30.

The first die unit 20 and the second die unit 22 are disposed to face each other in the up-down direction Z. The press tooling 100*a* according to the embodiment is a device for subjecting the sheet-like material 300 placed between the first die unit 20 and the second die unit 22 to press forming by moving the first die unit 20 and the second die unit 22 closer relative to each other in the press direction.

In the embodiment, the up-down direction Z corresponds to the press direction. Further, in the embodiment, a direction in the press direction from the second die unit 22 toward the first die unit 20 is defined as a first direction Z1, and a direction from the first die unit 20 toward the second die unit 22 is defined as a second direction Z2.

The first die unit 20 includes the punch 32 and the holder 34. The punch 32 includes a base part 32*a* fixed to a bolster of a pressing machine, which is not illustrated, and a punch body part 32*b* that is caused to protrude from the base part 32*a* in the second direction Z2 (upward). In the embodiment, a protrusion 32*c* that has a rectangular shape as seen in a plan view is formed in the center portion of the base part 32*a*, and the punch body part 32*b* is provided such that the punch body part 32*b* is caused to protrude from the protrusion 32*c* in the second direction Z2.

The holder 34 has a hollow and rectangular shape as seen in a plan view. The punch body part 32*b* of the punch 32 is provided such that the punch body part 32*b* penetrates the holder 34 in the up-down direction Z. In the embodiment, the holder 34 is provided in a movable manner with respect to the punch body part 32*b* in the up-down direction Z. The holder 34 is also supported by a plurality of supporting pins 35 extending in the up-down direction Z.

The plurality of supporting pins 35 is provided such that the supporting pins 35 penetrate the base part 32*a* of the punch 32 in the up-down direction Z and in a movable manner with respect to the punch 32 in the up-down direction Z. In the embodiment, a force F1 in the first direction Z1 is applied to the holder 34 via the plurality of supporting pins 35 from a die cushion device of the pressing machine, which is not illustrated. In this way, the holder 34 is biased toward the second die unit 22. Although a detailed description is omitted, instead of the supporting pin 35 and the die cushion device, any other device incorporated in the punch 32 such as a gas spring device and a coil spring may be used to bias the holder 34.

In the embodiment, the movement of the holder 34 is constrained so that the holder 34 does not protrude beyond the punch body part 32*b* in the second direction Z2. In the embodiment, the punch 32 and the holder 34 are provided such that an upper surface of the punch body part 32*b* is flush with an upper surface of the holder 34 while a force in the first direction Z1 is not applied from the second die unit 22 to the holder 34 (in the home positions of the punch 32 and the holder 34). However, the positional relationship between the punch and the holder may be altered as necessary depending on shapes or the like of pressed components to be produced.

In the embodiment, elements of the hold device 1*a* are attached to the first die unit 20 and the second die unit 22. Specifically, as components attached to the first die unit 20, the hold device 1*a* includes a plurality of distance members 24, a plurality of supporting members 25, a plurality of moving devices 26, a plurality of supporting members 27, and a plurality of return devices 28. Further, as components attached to the second die unit 22, the hold device 1*a* includes a plurality of receiving members 39.

The plurality of supporting members 25 of the hold device 1*a* are fixed to side surfaces of the holder 34. In the embodiment, two supporting members 25 are fixed to one side of the holder 34 in the width direction X, and other two supporting members 25 are fixed to the other side of the holder 34 in the width direction X. The supporting members 25 are fixed to the holder 34 by means of, for example, fastening members such as bolts. In the embodiment, for example, through-holes for passing the bolts in the width direction X are formed in the supporting members 25 and bolt holes for screwing the bolts in the width direction X are formed in the holder 34. The bolts can be screwed into the holder 34 from outside of the press tooling 100*a* such that the bolts penetrate the supporting members 25 to fix the supporting members 25 to the holder 34. In the embodiment, for example, once any component (moving part 24*a* or the like) of the hold device 1*a* is worn out, a shim plate and the like can be placed between the bolt and the supporting member 25 to adjust the position of the component of the hold device 1*a*. A recess 25*a* that has substantially an arc shape in cross section and opens toward the second direction Z2 is formed on each of the supporting members 25.

In the embodiment, the hold device 1*a* includes four distance members 24. Each of the distance members 24 includes a bar-like moving part 24*a*, a pair of plate-like arm parts 24*b*, and a pair of cylindrical pressing parts 24*c*. One end portion (lower end portion) of the moving part 24*a* is fitted into the recess 25*a* of the supporting member 25 such that the moving part 24*a* is pivotable in the width direction X. In this way, the moving part 24*a* is supported by the supporting member 25 such that the moving part 24*a* is pivotable in the width direction X with the lower end portion serving as a pivoting center. In other words, the moving part 24*a* is pivotably attached to the holder 34 via the supporting member 25. In the embodiment, the distance member 24 is attached to the holder 34 such that the distance member 24 can be caused to pivot between a home position (position illustrated in FIG. 8) in which the distance member 24 does not come into contact with the second die unit 22 and a preventive position (positions illustrated in FIGS. 11 and 12) described later. Although a detailed description is omitted, the moving part 24*a* may be pivotably (capable of turning) supported by the supporting member 25 via a support shaft extending in the length direction Y.

One end portion of each of the pair of arm parts 24*b* in the width direction X is fixed at the lower end portion of the moving part 24*a*. The other end portion of each of the pair of arm parts 24*b* in the width direction X has each one of the pressing parts 24*c* fixed thereto.

In the embodiment, corresponding to four distance members 24, the hold device 1*a* includes four moving devices 26, four supporting members 27, and four return devices 28. Each of the moving devices 26 includes a pair of elastic members 26*a* and a pair of transmission members 26*b*. In the embodiment, the elastic member 26*a* is a coil spring. In the following, the elastic member 26*a* will be referred to as a coil spring 26*a*.

Transmission members 26*b* each include a shaft portion 6*a* extending in the up-down direction Z, a flange portion 6*b* provided at an upper end portion of the shaft portion 6*a*, and a flange portion 6*c* provided at a lower end portion of the shaft portion 6*a*. The transmission member 26*b* is inserted in each one of the supporting members 27 such that the transmission member 26*b* is movable in the up-down direction. The coil spring 26*a* is fitted around the shaft portion 6*a* between the flange portion 6*b* and the supporting member 27. The coil spring 26*a* is arranged to push the flange portion 6*b* toward the second direction Z2 (upward). In the embodiment, the flange portion 6*c* is engaged with the supporting member 27, so that the transmission member 26*b* is constrained from moving in the second direction Z2. The supporting member 27 is fixed to the punch 32 by means of, for example, fastening members such as bolts. In other words, in the embodiment, the moving device 26 is attached to the first die unit 20 via the supporting member 27.

In the embodiment, in the home position of the distance member 24, the moving device 26 is provided such that the pressing part 24*c* is located on the flange portion 6*b*. In the home position of the distance member 24, the flange portion 6*b* may be in contact with the pressing part 24*c* or the flange portion 6*b* is away from the pressing part 24*c* in the up-down direction Z. However, even when the flange portion 6*b* is away from the pressing part 24*c*, the distance between the flange portion 6*b* and the pressing part 24*c* in the up-down direction Z is preferably small.

As described in detail later, the moving device 26 is a device for causing the distance member 24 to pivot from the home position (position illustrated in FIG. 8) toward the preventive position (positions illustrated in FIGS. 11 and 12) as the holder 34 moves relative to the punch 32 in the first direction Z1.

In the embodiment, the return device 28 is provided on the supporting member 25. Although a detailed description is omitted, the return device 28 includes a coil spring, is connected to the distance member 24, and biases the distance member 24 to return the distance member 24 to the home position.

The second die unit 22 includes the die 36 and the pad 38. The die 36 includes a base part 36*a* fixed to a slide of a pressing machine, which is not illustrated, and a die body part 36*b* that is caused to protrude from the base part 36*a* in the first direction Z1 (downward). As seen from below, the die body part 36*b* has a hollow and rectangular shape. The die body part 36*b* is provided to face the holder 34 in the up-down direction Z.

The pad 38 includes a pad body part 38*a* extending in the length direction Y inside the die body part 36*b* and a plurality of (in the embodiment, four) arm parts 38*b* extending in the width direction X from the pad body part 38*a* to penetrate through the die body part 36*b*. The pad body part 38*a* is provided to face the punch body part 32*b* of the punch 32 in the up-down direction Z.

Outside the die body part 36*b*, each one of the receiving members 39 of the hold device 1*a* is attached to a distal end of each of the arm parts 38*b*. In the embodiment, the receiving member 39 is fixed to the arm part 38*b* by means of, for example, fastening members such as bolts. Note that how the receiving member 39 is attached to the arm part 38*b* can be achieved in a similar manner that the supporting member 25 is attached to the holder 34, and therefore a detailed description is omitted. The receiving member 39 includes an engaging part 39*a* that has substantially a rectangular shape as seen in the length direction Y and fixed to the arm part 38*b*, and a catcher portion 39*b* extending downward from the engaging part 39*a*. The engaging part 39*a* is provided to face the supporting member 25 of the hold device 1*a* in the up-down direction Z.

As illustrated in FIG. 8, a plurality of biasing devices 40 are provided between the base part 36*a* of the die 36 and the pad body part 38*a* of the pad 38. In the embodiment, each of the biasing devices 40 includes, for example, a gas spring, and applies a force F2 to the pad body part 38*a* in the second direction Z2. In this way, the pad 38 is biased toward the first die unit 20. As the biasing device 40, any other devices such as a coil spring may be used instead of the gas spring.

In the embodiment, the die 36 and the pad 38 are provided such that a lower surface of the die body part 36*b* is flush with a lower surface of the pad body part 38*a* at the home position of the die 36 and the pad 38. The positional relationship between the die and the pad may be altered as necessary depending on shapes or the like of pressed components to be produced.

The stopper device 30 is provided on the engaging part 39*a* of each of the receiving members 39. Although a detailed description is omitted, the stopper device 30 includes a stopper member 30*a*, a retaining member 30*b* for retaining the stopper member 30*a* between the retaining member 30*b* and the engaging part 39*a* such that the stopper member 30*a* is movable in the up-down direction Z, and an elastic member 30*c* for biasing the stopper member 30*a* downward with respect to the retaining member 30*b*. The stopper member 30*a* is arranged to protrude beyond the engaging part 39*a* in the first direction Z1 (downward) at the home position.

(Operation of Hold Device and Press Tooling)

The operation of the hold device 1*a* and the press tooling 100*a* will now be described. FIGS. 9 to 13 illustrate a production method of a pressed component by means of the hold device and the press tooling. In the embodiment, the pressed component is produced from the material by executing first to fifth steps as described below.

(First Step)

As illustrated in FIG. 8, the sheet-like material 300 is first placed on the punch 32 and the holder 34. At this time, the first die unit 20 is separated from the second die unit 22 in the up-down direction Z. In the first step, the constituent members of the hold device 1*a* and the press tooling 100*a* are in the home position. Note that the distance member 24 is away from the second die unit 22 in the home position. Further, in the home position, an upper end portion of the moving part 24*a* of the distance member 24 is located outside the engaging part 39*a* of the receiving member 39 in the width direction X. Further, in the home position, the upper end portion of the moving part 24*a* faces a lower end portion of the stopper member 30*a* in the up-down direction Z.

As the material 300, a high-strength material that has a tensile strength of 590 to 1600 MPa, for example.

(Second Step)

Next, as illustrated in FIGS. 9 and 10, the first die unit 20 and the second die unit 22 move toward each other in the up-down direction Z. Specifically, as illustrated in FIG. 9, a pressing machine, which is not illustrated, causes the second die unit 22 (die 36) to move in the first direction Z1 with respect to the first die unit 20. In this way, the material 300 is clamped between the punch 32 (punch body part 32*b*) and the holder 34, and the pad 38 (pad body part 38*a*) and the die 36 (die body part 36*b*). Further, the stopper member 30*a* of each stopper device 30 is pushed by the moving part 24*a*, so that the stopper member 30*a* moves relative to the engaging part 39*a* of the receiving member 39 in the second direction Z2. Note that in FIG. 9, the distance member 24 is in the home position.

As illustrated in FIG. 10, the die 36 moves further relative to the first die unit 20 in the first direction Z1, so that the holder 34 and the die 36 move relative to the punch 32 and the pad 38 in the first direction Z1. In this way, shaping of the material 300 is started. Specifically, in the material 300, a center portion in the width direction X (a portion between the punch body part 32*b* and the pad body part 38*a*) is extruded toward the second direction Z2 with respect to opposite end portions in the width direction X (a portion between the holder 34 and the die body part 36*b*).

Further, the holder 34 moves relative to the punch 32 in the first direction Z1, so that the distance member 24, which is attached to the holder 34 via the supporting member 25, moves relative to the moving device 26, which is attached to the punch 32 via the supporting member 27, in the first direction Z1. In this way, the transmission member 26*b* is pushed by the pressing part 24*c* in the first direction Z1, compressing the coil spring 26*a*. As a result, in the coil spring 26*a*, a repulsive force that pushes the transmission member 26*b* in the second direction Z2 is generated. In other words, in the embodiment, the coil spring (elastic member) 26*a* functions as a repulsive-force generator that generates a repulsive force in the second direction Z2 by being pressed by the distance member 24 in the first direction Z1 via the transmission member 26*b*. The repulsive force in the second direction Z2 generated in the coil spring 26*a* is transmitted to the pressing part 24*c* of the distance member 24 via the transmission member 26*b*. In this way, a force to cause the distance member 24 to pivot (or turn) inward of the press tooling 100*a* with the lower end portion of the moving part 24*a* as a pivoting center is applied from the moving device 26 to the distance member 24. However, immediately after the shaping of the material 300 is started, movement of the moving part 24*a* inward of the press tooling 100*a* is constrained by the engaging part 39*a*. In other words, the distance member 24 is constrained from pivoting inwardly by the engaging part 39*a*.

(Third Step)

As illustrated in FIG. 11, the holder 34 and the die 36 move further in the first direction Z1 with respect to the punch 32 and the pad 38 and reach a forming bottom dead center (forming-completion position). As a result, the pressed component 200 that has a predetermined forming height is obtained. At this time, the distance member 24 moves in the first direction Z1 along with the holder 34, increasing the repulsive force in the second direction Z2 generated in the moving device 26. In other words, a force tending to cause the distance member 24 to pivot inward of the press tooling 100*a* increases. In this state, the distance between the holder 34 and the receiving member 39 (the engaging part 39*a*) in the up-down direction Z increases to allow the moving part 24*a* to move inwardly. As a result, the distance member 24 quickly pivots inward of the press tooling 100*a*.

When the moving part 24*a* pivots to a position where the moving part 24*a* comes into contact with the catcher portion 39*b*, the stopper member 30*a* is pushed by the elastic member 30*c* to move in the first direction Z1. In this way, the moving part 24*a* is kept clamped between the catcher portion 39*b* and the stopper member 30*a*. As a result, the moving part 24*a* is constrained from pivoting. In other words, the distance member 24 is constrained from pivoting.

In the state illustrated in FIG. 11, the pad 38 is constrained from moving relative to the holder 34 in the first direction Z1 by the moving part 24*a* of the distance member 24. In this way, the distance between the holder 34 and the pad body part 38*a* in the up-down direction Z is maintained at or larger than a predetermined forming height. In other words, in the state illustrated in FIG. 11, the distance between the holder 34 and the pad 38 in the up-down direction Z is prevented from being equal to or less than a predetermined distance by the distance member 24. In the embodiment, a position of the distance member 24 (position illustrated in FIG. 11) in which the distance between the holder 34 and the pad 38 in the up-down direction Z is prevented from being equal to or less than a predetermined distance is referred to as a preventive position.

(Fourth Step)

Next, as illustrated in FIG. 12, the die 36 moves relative to the first die unit 20 in the second direction Z2. In this way, the holder 34 and the pad 38 move relative to the punch 32 in the second direction Z2 along with the die 36. As a result, the punch body part 32*b* of the punch 32 moves relative to the pad body part 38*a* of the pad 38 in the first direction Z1. In other words, the punch body part 32*b* relatively moves away from the pad body part 38*a*.

Here, as described above, the distance between the holder 34 and the pad body part 38*a* in the up-down direction Z is maintained at or larger than a predetermined forming height by the moving part 24*a* of the distance member 24. In other words, the pressure applied from the holder 34 in the second direction Z2 and the pressure applied from the pad 38 in the first direction Z1 are both received by the moving part 24*a* of the distance member 24. In this way, a large pressure can be prevented from being applied to the pressed component 200 from the holder 34 and the pad 38. As a result, during the release, it is possible to prevent deformation of the pressed component 200.

(Fifth Step)

Finally, as illustrated in FIG. 13, the first die unit 20 and the second die unit 22 are further separated away from each other in the up-down direction Z, and the pressed component 200 is taken out. At this time, the distance member 24 is returned to the home position by the return device 28.

Advantageous Effect of The Embodiment

As described above, in the hold device 1*a* according to the embodiment, similarly to the above-described hold device 1, both the distance member 24 and the moving device 26 are configured to be attached to the first die unit 20. Accordingly, similarly to the hold device 1, the hold device 1*a* can be used to sufficiently suppress a damage on the distance member 24 and the moving device 26. Further, similarly to the hold device 1, even for a transfer-type pressing machine, it is possible to properly utilize the hold device 1*a*.

Further, similarly to the hold device 1, components of the hold device 1*a* according to the embodiment are attachable to and removable from the press tooling 100*a*. Accordingly, with provision of a spare for the hold device 1*a*, even when any of components in the hold device 1*a* fails, the component can be replaced, so that the failure can be rapidly addressed.

Further, although a detailed description is omitted, similarly to the hold device 1, in the embodiment, adjustment to the locking action is facilitated when the press tooling 100*a* is to be assembled to a pressing machine, the assembly precision of the hold device 1*a* can easily be improved, the hold device 1*a* can easily be maintained, running costs can be reduced, and design man-hours for the press tooling 100*a* can be reduced.

Further, in the embodiment, the press tooling 100*a* only needs to be configured such that the hold device 1*a* is attachable to and removable from the press tooling 100*a*, so that essential portions of the press tooling 100*a* can be constructed by using a configuration of a known press tooling. In this way, production costs of the press tooling 100*a* can be suppressed.

Further, in the case in which the moving device is provided on the second die unit 22, it has been necessary to provide a member (for example, an outer cam in Patent Document 1) that can cover the distance member 24 from the outside. In this regard, in the embodiment, the distance member 24 can be caused to pivot to the preventive position by pushing the distance member 24 by the moving device 26 in the second direction Z2. In this case, the moving device 26 can be constructed in a simple manner, and therefore the size of the press tooling 100*a* can be reduced.

Further, in the embodiment, the moving device 26 generates a force for pivoting the distance member 24 by the coil spring 26*a*. In this case, the moving device 26 can be constructed in a small size, while a sufficient force can be generated. Further, using the coil spring 26*a* can allow a forming cycle of the pressed component 200 to be reduced, so that the productivity can be enhanced. Further, since no control is required on the moving device 26, production costs can be reduced.

Further, in the hold device 1*a* according to the embodiment, the moving device 26 transmits a force for pivoting the distance member 24 to the distance member 24 at a position (in the embodiment, the pressing part 24*c*) different from a position where the distance member 24 is subjected to a load from the pad 38 (in the embodiment, the upper end portion of the moving part 24*a* in contact with the receiving member 39). In this case, it is possible to sufficiently suppress a damage on the distance member 24 as compared to a case in which the position where the distance member 24 is subjected to the load coincides with the position where the force for pivoting is transmitted.

Further, in the hold device according to the embodiment, for example, as illustrated in FIG. 14, the angle of the moving part 24*a* in the home position may be altered. Specifically, in the home position, the position of an upper end of the moving part 24*a* may be adjusted to be substantially flush with the upper surfaces of the holder 34 and the punch 32. In this case, for example, when the hold device is utilized in a transfer-type pressing machine, it is easier to place the material 300 and take out the pressed component 200, and therefore production efficiency can be enhanced.

In the distance member 24, the distance between the position where the distance member 24 is subjected to the load and a pivoting center may be set to be larger than the distance between the position where the force for pivoting is transmitted and the pivoting center. In this case, the distance member 24 can be rapidly moved from the home position to the preventive position. On the other hand, in the distance member 24, the distance between the position where the distance member 24 is subjected to the load and a pivoting center may be set to be equal to or less than the distance between the position where the force for pivoting is transmitted and the pivoting center. In this case, a smaller force can be used to pivot the distance member 24.

In the embodiment, although description has been made as to the case in which the moving device 26 is attached to the punch 32, the moving device may be attached to any other component of the first die unit than the punch 32. For example, the moving device may be attached to another component fixed to the bolster.

The configuration of the moving device is not limited to the above-described example, and the moving device only needs to be configured such that the distance member is caused to pivot from the home position toward the preventive position as the holder moves relative to the punch in the first direction. Accordingly, for example, an actuator such as an air cylinder, a hydraulic cylinder, an electric cylinder, and an electric motor may be used for the moving device. For example, when such an actuator is used for the moving device, the moving device may be attached to the supporting member 25 or the holder 34 and a rotating shaft connected to the distance member may be rotated by the moving device to cause the distance member to pivot. Note that when an actuator is used for the moving device, the actuator may also function as the return device. In this case, the configuration of the press tooling may be made simpler. Further, although in the embodiment, description has been made as to the case in which a coil spring is used for the repulsive-force generator of the moving device, an extension spring, a torsion coil spring, a leaf spring, rubber, an accumulator, a gas spring, and the like may be used solely or in combination for the repulsive-force generator. For example, as with the moving device 26 illustrated in FIG. 15, a gas spring 60 embedded in the supporting member 27 may be used instead of the coil spring 26*a* (see FIG. 8). In this case, the gas spring 60 generates a repulsive force in the second direction Z2 by being pressed by the distance member 24 in the first direction Z1 via the transmission member 26*b*. In this way, the transmission member 26*b* is biased in the second direction Z2.

Further in the embodiment, although description has been made as to the case in which the hold device 1*a* has four distance members 24 and four moving devices 26, there may be not more than three or five or more distance members 24 and the moving devices 26. Specifically, the number and the arrangement of the distance members 24 and the moving devices 26 may be altered as necessary in consideration of forming conditions such as press loads and load distribution.

Further the shape of the moving part 24*a* is not limited to the above-described example. Specifically, the moving part 24*a* may not be of a bar shape. Further, the configuration of the supporting member 25 may also not be limited to the above-described example, and the supporting member 25 only needs to be configured such that the distance member 24 can be pivotably attached to the holder 34. Further, the supporting member 27 only needs to be configured such that the moving device 26 can be attached to the first die unit 20.

Further, in the embodiment, the distance member 24 is subjected to a load from the pad 38 via the receiving member 39 in the preventive position to prevent the distance between the pad 38 and the holder 34 in the up-down direction Z from being equal to or less than a predetermined distance. However, it may be possible to prevent the distance between the pad and the holder in the up-down direction Z from being equal to or less than a predetermined distance by the distance member being subjected to a load directly from the pad in the preventive position. In this case, for example, the pad 38 and the receiving member 39 illustrated in FIG. 8 may be integrally formed as a pad.

Further, in the above-described hold device 1*a*, the return device 28 is used to return the distance member 24 to the home position. However, for example, as with the hold device 1*b* illustrated in FIGS. 16 and 17, a weight part 50 may be attached to the distance member 24 instead of the return device 28 such that the distance member 24 is returned to the home position by the distance member 24 under its own weight. Although a detailed description is omitted, the return device may be formed of a torsion coil spring, or may be formed of an actuator such as an air cylinder, a hydraulic cylinder, an electric cylinder, and an electric motor.

Further, in the above-described press tooling 100*a*, the catcher portion 39*b* is formed on the receiving member 39 and the stopper device 30 is provided on the receiving member 39 to ensure that the distance member 24 is constrained from pivoting in the preventive position. However, in the case in which the distance member 24 can be prevented from pivoting in the preventive position by clamping the distance member 24 between the supporting member 25 and the receiving member 39, the catcher portion 39*b* and the stopper device 30 may be omitted as with a press tooling 100*b* illustrated in FIGS. 16 and 17.

Although a detailed description is omitted, in the case in which the hold device is used in the press tooling 100*b* as illustrated in FIGS. 17 to 22, the pressed component 200 can be produced from the material 300 by performing similar steps to the case in which the hold device is used in the press tooling 100*a*.

The present invention can be applied to pressed components of various shapes, various press methods, and materials of various qualities. For example, the present invention can be used to produce a pressed component 10 illustrated in FIG. 23. Referring to FIG. 23, the pressed component 10 has a hat-shaped cross section. The pressed component 10 includes a top plate 11, vertical walls 12*a* and 12*b* extending in the up-down direction, and flanges 13*a* and 13*b*. Upper end portions of the vertical walls 12*a* and 12*b* are connected to the top plate 11 via ridge portions 14*a* and 14*b* that are curved to be convex outward of the pressed component 10. Lower end portions of vertical walls 12*a* and 12*b* are connected to the flanges 13*a* and 13*b* via ridge portions 15*a* and 15*b* that is concave inward of the pressed component 10. When viewed in a direction normal to the vertical walls 12*a* and 12*b*, the pressed component 10 includes curved portions 16 and 17 that are curved in a height direction of the vertical walls 12*a* and 12*b*. When such a pressed component 10 is to be produced, shapes of portions of the first die unit and the second die unit may be adjusted in accordance with the shape of the pressed component 10.

Further, although a detailed description is omitted, in addition to components that have a hat-shaped cross section, the present invention can be used to produce, for example, a doughnut-shaped component illustrated in FIG. 24, a cylindrical component illustrated in FIG. 25, a spherical component illustrated in FIG. 26, ring-shaped components illustrated in FIGS. 27 to 30, an A pillar, a B pillar illustrated in FIG. 31, an A pillar lower illustrated in FIG. 32, a front side member illustrated in FIG. 33, a rear side member, a rear floor side member, and a roof rail illustrated in FIG. 34.

REFERENCE SIGNS LIST

1, 1*a*, 1*b* hold device
100, 100*a*, 100*b* press tooling
20 first die unit
22 second die unit
24 distance member
25 supporting member
26 moving device
27 supporting member
28 return device
30 stopper device
32 punch
34 holder
36 die
38 pad
39 receiving member
40 biasing device

The invention claimed is:

1. A hold device configured to be attached to a press tooling, wherein the press tooling includes: a first die unit that has a punch and a holder; and a second die unit that has a pad disposed to face the punch and a die disposed to face the holder, the first die unit and the second die unit move closer relative to each other in a press direction to perform press forming on a sheet-like material placed between the first die unit and the second die unit, the holder is provided in a movable manner with respect to the punch in the press direction, and the pad is provided in a movable manner with respect to the die in the press direction, wherein the hold device comprises:

a distance member configured to be pivotably attached to the holder; and a moving device configured to be attached to the first die unit such that the distance member attached to the holder is pivotable in a state where the distance member is attached to the press tooling, and wherein in the press direction, when a direction from the second die unit to the first die unit is defined as a first direction and a direction opposite to the first direction is defined as a second direction, and in a state in which the distance member and the moving device is attached to the press tooling, the distance member is pivotable between a home position in which the distance member does not come into contact with the second die unit and a preventive position in which a distance between the pad and the holder in the press direction is prevented from being equal to or less than a predetermined distance, as the holder moves relative to the punch in the first direction, the moving device causes the distance member to pivot from the home position toward the preventive position, and the distance member is further configured to, after the distance member is positioned in the preventive position, pivot toward the home position as the pad moves relative to the holder in the second direction.

2. The hold device according to claim 1, wherein the moving device includes a repulsive-force generator, and is directly or indirectly fixed to the punch, the distance member presses the repulsive-force generator in the first direction as the holder moves relative to the punch in the first direction, the repulsive-force generator is pressed by the distance member in the first direction to thereby generate a repulsive force in the second direction, and the distance member pivots from the home position toward the preventive position upon receipt of the repulsive force in the second direction from the repulsive-force generator.

3. The hold device according to claim 1, further comprising:

a supporting member that pivotably supports the distance member, wherein the distance member is configured to be attached to the holder via the supporting member.

4. The hold device according to claim 1, further comprising a receiving member that is configured to be fixed to the pad such that the receiving member is not in contact with the distance member in the home position and comes into contact with the distance member in the preventive position, wherein the distance member is subjected to the load in the first direction from the pad via the receiving member in the preventive position to thereby prevent the distance between the pad and the holder in the press direction from being equal to or less than the predetermined distance.

5. The hold device according to claim 1, wherein the distance member is directly or indirectly subjected to a load in the first direction from the pad in the preventive position to prevent the distance between the pad and the holder in the press direction from being equal to or less than the predetermined distance.

6. The hold device according to claim 5, wherein the moving device transmits a force for pivoting the distance member to the distance member at a position different from a position where the distance member is directly or indirectly subjected to the load from the pad.

7. The hold device according to claim 6, wherein in the distance member, a distance between the position where the distance member is subjected to the load and a pivoting center is larger than a distance between the position where the force is transmitted from the moving device and the pivoting center.

8. The hold device according to claim 6, wherein in the distance member, a distance between the position where the distance member is subjected to the load and a pivoting center is equal to or less than a distance between the position where the force is transmitted from the moving device and the pivoting center.

* * * * *